US007309087B2

(12) United States Patent
Lane et al.

(10) Patent No.: US 7,309,087 B2
(45) Date of Patent: Dec. 18, 2007

(54) LATCH ASSEMBLY FOR MOVABLE CLOSURE ELEMENT

(75) Inventors: Christopher M. Lane, Nashua, IA (US); Craig Helton, Charles City, IA (US); Dennis J. Zweibohmer, Ionia, IA (US); Joe Daniel Knight, Nashua, IA (US); Ricci L. Marzolf, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 482 days.

(21) Appl. No.: 10/316,359

(22) Filed: Dec. 11, 2002

(65) Prior Publication Data

US 2004/0113441 A1 Jun. 17, 2004

(51) Int. Cl.
*E05C 3/06* (2006.01)
*E05B 3/00* (2006.01)

(52) U.S. Cl. ..... 292/216; 292/92; 292/336.3

(58) Field of Classification Search ..... 292/216, 292/11, 24, 27, 56, 336.3, 347, 348, 350–355, 292/92, 93, 244, DIG. 53; 70/92
See application file for complete search history.

(56) References Cited

U.S. PATENT DOCUMENTS 621,574 A * 3/1899 Kinsey ..... 292/24
1,059,952 A * 4/1913 Spooner ..... 292/336.3
1,810,350 A * 6/1931 Hines ..... 292/336.3
2,117,160 A * 5/1938 Gale ..... 292/336.3
2,485,000 A 10/1949 Jakeway
2,683,053 A * 7/1954 Russell et al. ..... 292/336.3
2,700,290 A * 1/1955 Dall ..... 70/135
2,825,596 A * 3/1958 Nagy ..... 292/336.3
2,887,865 A * 5/1959 Moler ..... 70/149
2,976,072 A * 3/1961 Muttart ..... 292/336.3
3,087,323 A * 4/1963 Foster ..... 70/92
3,214,947 A * 11/1965 Wikkerink ..... 70/92
3,287,054 A * 11/1966 Russell et al. ..... 292/336.3
3,393,934 A * 7/1968 Stebbins ..... 292/92
3,495,861 A * 2/1970 Snow ..... 292/74
3,784,241 A * 1/1974 Pickles ..... 292/216
3,848,909 A 11/1974 Foley
3,865,414 A * 2/1975 Schlage ..... 292/336.3

(Continued)

FOREIGN PATENT DOCUMENTS

DE 80 34 789 U1 12/1980

(Continued)

*Primary Examiner*—Carlos Lugo
(74) *Attorney, Agent, or Firm*—Wood Phillips et al

(57) ABSTRACT

A latch assembly kit including a latching subassembly, a first actuating assembly having a first configuration and normal and release states, and a second actuating assembly having a second configuration and normal and release states. The latching subassembly has a latched state, and a release state. The first actuating assembly is mountable on the first side of a movable closure element and causes the latching subassembly to change from its latched state into its release state as an incident of the first actuating assembly changing from its normal state into its release state. The second actuating assembly is mountable in place of the first actuating assembly and causes the latching subassembly to change from its latched state into its release state as an incident of the second actuating assembly changing from its normal state into its release state.

39 Claims, 19 Drawing Sheets

U.S. PATENT DOCUMENTS 3,934,435 A * 1/1976 Gresham ..... 70/150
4,006,927 A * 2/1977 Recupero ..... 292/336.3
4,121,864 A * 10/1978 Kagoura ..... 292/202
4,123,097 A * 10/1978 Allemann ..... 292/336.3
4,382,620 A * 5/1983 Horgan, Jr. ..... 292/92
4,480,451 A * 11/1984 Fujiya ..... 70/92
4,511,166 A * 4/1985 Weinerman ..... 292/29
4,545,606 A * 10/1985 Vodra ..... 292/92
4,732,417 A * 3/1988 Yang ..... 292/142
4,835,997 A * 6/1989 Akright ..... 70/141
4,836,707 A * 6/1989 Myers ..... 403/322.4
4,895,399 A * 1/1990 Horgan, Jr. ..... 292/92
4,951,486 A * 8/1990 Braun et al. ..... 70/208
4,982,986 A * 1/1991 Gressett et al. ..... 292/336.3
5,085,474 A * 2/1992 Toledo et al. ..... 292/92
5,088,778 A * 2/1992 Lin ..... 292/336.3
5,127,686 A * 7/1992 Gleason et al. ..... 292/216
5,209,530 A * 5/1993 Kolloch ..... 292/27
5,403,047 A * 4/1995 Walls ..... 292/173
5,481,890 A * 1/1996 Millman ..... 70/224
5,520,423 A * 5/1996 Finkelstein et al. ..... 292/146
5,531,488 A 7/1996 Yoshikuwa et al.
5,624,141 A * 4/1997 Kuo et al. ..... 292/165
5,700,044 A * 12/1997 Wartian ..... 292/336.3
5,860,684 A 1/1999 Mizuki
5,947,534 A * 9/1999 Zarzycki, Jr. ..... 292/92
5,984,383 A * 11/1999 Parikh et al. ..... 292/121
6,152,498 A * 11/2000 Lindqvist ..... 292/53
6,357,807 B1 * 3/2002 Fan ..... 292/226
6,419,284 B1 * 7/2002 Kutschat ..... 292/56
6,454,321 B1 * 9/2002 Parikh ..... 292/216
6,491,327 B1 * 12/2002 Fan ..... 292/165
6,640,593 B1 * 11/2003 Hannah et al. ..... 70/224
6,651,467 B1 * 11/2003 Weinerman et al. ..... 70/208
2001/0006293 A1 * 7/2001 Rupp ..... 292/336.3

FOREIGN PATENT DOCUMENTS

DE 90 12 540 U1 1/1990
GB 2045336 10/1980
GB 2159571 12/1985

* cited by examiner

LATCH ASSEMBLY FOR MOVABLE CLOSURE ELEMENT

BACKGROUND OF THE INVENTION

1. Field of the Invention

This invention relates to latch assemblies for releasably maintaining movable closure elements in a desired position relative to a support therefor.

2. Background Art

Myriad designs for latch assemblies for maintaining movable closure elements in a desired position relative to a support upon which the movable closure element is mounted have been devised over the years. Different demands are placed upon these mechanisms depending upon their particular environment. However, designers of these latch assemblies universally consider and balance the following factors in their designs: 1) reliability; 2) holding capacity; 3) convenience of operation; 4) ease of manufacture; 5) ease of assembly; 6) versatility; and 7) cost. Certain of the above factors are competing in the design process and, generally, particular applications will dictate where compromises must be made. Ideally, one would optimize each of these design areas.

The agricultural and construction industries are ones in which rather severe demands are placed upon latch assemblies. Severe stresses are commonly placed on closure elements on cabs of tractors and the like. At the same time, convenience of actuation is a prime consideration, as when a hasty exit must be made from such a vehicle. This has lead to the use of squeeze-actuated assemblies of the type shown in U.S. Pat. No. 6,419,284. The squeeze actuator is integrated into a bar which facilitates manipulation of the closure element as well as accessibility to the lever that is squeezed while gripping the bar to release the latch assembly to permit opening of the closure element. However, the latch assembly designs, of the type shown in U.S. Pat. No. 6,419,284, have tended towards the complicated. For example, the design shown in U.S. Pat. No. 6,419,284 uses two separate, indirect mechanisms for moving a catch element through separate internal and external actuating assemblies on the closure element. This indirect actuation requires intermediate parts which may complicate the manufacturing process and increase associated costs. Indirect mechanisms, by their nature, introduce additional parts movement that could account for a field failure.

Typically, latch assemblies are designed to be operated by interior and exterior actuating assemblies, each with a specific design. There currently exist a number of different types of actuating assemblies, among which are actuating assemblies utilizing a pivotable trip lever that operates in conjunction with an elongate handle to be squeeze operated, actuating assemblies having a pull-type, graspable handle, and actuating assemblies utilizing a depressible element, i.e. a push button system. Some of these latch assemblies have mechanisms which cooperate with strike elements in the same manner. The difference between these latch assemblies may thus reside only in the configuration of the actuating assemblies. These various types of latch assemblies are conventionally sold with a single, specific combination of interior and exterior actuating assemblies.

Accordingly, purveyors of this type of equipment are required to anticipate demands for a particular overall latch assembly configuration. Unless the latch assemblies are built to order, purveyors must make an educated estimate as to demands for a particular type of latch assembly, at the risk of carrying excess inventory of one style and having a shortage of another.

Additionally, offering a line of latch assemblies with different combinations of actuating assemblies may add appreciably to the cost of such systems. An increased number of assembly steps and/or lines may be required to offer latch systems with all available combinations of actuating assemblies.

The industry is constantly seeking out latch assemblies that are improved in one or more of the areas noted above.

SUMMARY OF THE INVENTION

In one form, the invention is directed to a latch assembly kit including a latching subassembly for mounting upon a movable closure element, a first actuating assembly having a first configuration and normal and release states, and a second actuating assembly having a second configuration that is different than the first configuration and normal and release states. The latching subassembly has a latched state, wherein the latching subassembly releasably engages a strike element to maintain the movable closure element in a desired position relative to a support to which the movable closure element is attached, and a release state. The first actuating assembly is mountable on the first side of the movable closure element and causes the latching subassembly to change from its latched state into its release state as an incident of the first actuating assembly changing from its normal state into its release state. The second actuating assembly is mountable to the first side of the movable closure element in place of the first actuating assembly. The second actuating assembly causes the latching subassembly to change from its latched state into its release state as an incident of the second actuating assembly changing from its normal state into its release state. With the above structure, the first and second actuating assemblies can be selectively interchangeably mounted to the first side of the movable closure element to operate the latching subassembly.

In one form, the first actuating assembly is a pushbutton actuator that is translatable from a normal position into a release position to thereby change the latching subassembly from its latched state into its release state.

In another form, the first actuating assembly has an actuating handle that is mounted for pivoting movement between normal and release positions to thereby change the latching subassembly from its latched state into its release state.

The kit may further include a third actuating assembly mountable to the second side of the movable closure element and having normal and release states. The third actuating assembly causes the latching subassembly to change from its latched state into its release state as an incident of the third actuating assembly changing from its normal state into its release state.

In one form, the third actuating assembly includes a trip lever that is pivotable around an axis between normal and release positions to thereby change the latching subassembly from its latched state into its release state.

In one form, the trip lever is pivotable around a first axis between its normal and release positions and the first actuating assembly further has an actuating handle that is mounted for pivoting movement around a second axis between normal and release positions to thereby change the latching subassembly from its latched state into its release state.

The first and second axes may be parallel or orthogonal to each other, or at another angle, preferably between parallel and orthogonal.

In one form, the first and second axes reside in planes that do not intersect the movable closure element upon which the latching subassembly and first and third actuating assemblies are mounted.

In one form, the latching subassembly has a rotor that is pivotable between a latched position and a release position. The rotor is engageable with a strike element relative to which the movable closure element can be moved to thereby releasably maintain the movable closure element in a desired position.

The latch assembly kit may further include a catch block assembly that is movable selectively between an engaged position, wherein the rotor is maintained in its latched position, and a disengaged position, wherein the rotor is permitted to move from its latched position into its release position.

The latch assembly kit may further include a trip catch that is movable from a first position into a second position to thereby change the catch block assembly from the engaged position into the disengaged position. The latch assembly kit may further include a third actuating assembly mountable to the second side of the movable closure element and having normal and release states, with the third actuating assembly causing the latching subassembly to change from its latched state into the release state as an incident of the third actuating assembly changing from its normal state into its release state. The third actuating assembly may include a trip lever that is movable between normal and release positions to thereby change the trip catch from the first position into the second position.

In one form, the trip catch is pivotable about a first axis between the first and second positions and the trip lever is pivotable about a second axis between its normal and release positions.

The first and second axes may be substantially parallel to each other. In one form, the first and second axes are coincident.

In one form, with the trip catch in the first position and the trip lever in its normal position, the trip catch can be moved from the first position into the second position without moving the trip lever from its normal position into its release position.

The actuating handle may have a projecting element/cantilevered connecting element that follows pivoting movement of the actuating handle and directly engages the catch block assembly.

In one form, the catch block assembly has a cantilevered post that engages the projecting element/cantilevered connecting element.

In one form, the catch block assembly has a second cantilevered post that is engaged by the first actuating assembly so that the catch block assembly moves from the engaged position into the disengaged position as the first actuating assembly is changed from its normal state into its release state.

The invention contemplates the above kit in combination with a movable closure element to which the latching subassembly is mounted.

The invention is further directed to a latch assembly including a latching subassembly for mounting upon a movable closure element having first and second sides and an operating assembly with a latching subassembly having a latched state, wherein the latching subassembly releasably engages a strike element to maintain the movable closure element in a desired position relative to a support to which the movable closure element is attached, and a release state. The operating assembly is operable to change the latching subassembly from the latched state into the release state. The operating assembly has a first actuating assembly with normal and release states. The first actuating assembly is mountable on the first side of the movable closure element and causes the latching subassembly to change from its latched state into its release state as an incident of the first actuating assembly changing from its normal state into its release state. The operating assembly further includes a catch block assembly that is movable selectively between an engaged position, wherein the latching subassembly is maintained in the latched state, and a disengaged position, wherein the latching subassembly is permitted to be changed from its latched state into its release state. The operating assembly further includes a trip catch that is movable between a first position and a second position to thereby cause the catch block assembly to be moved from the engaged position into the disengaged position. The operating assembly further includes a trip lever that is movable between normal and release positions to cause the trip catch to move from the first position into the second position. The trip catch is movable from the first position into the second position without moving the trip lever from its normal position into its release position.

The latch assembly may further include a second actuating assembly on the second side of the movable closure element and having normal and release states. The second actuating assembly acts against the trip catch and causes the trip catch to change from the first position into the second position without moving the trip lever from its normal position into its release position as the second actuating assembly is changed from its normal state into its release state.

In one form, the second actuating assembly includes a pushbutton actuator having an element that is translatable between normal and release positions to change the trip catch from the first position into the second position.

In one form, the trip catch is movable between the first and second positions by pivoting around a first axis.

The trip lever may be movable from its normal position into its release position by pivoting around a second axis.

In one form, the first and second axes are substantially parallel to each other.

In one form, the first and second axes are substantially coincident.

The latching subassembly may include a rotor that is pivotable between latched and release positions and the rotor is engageable with a strike element relative to which the movable closure element can be moved to thereby releasably maintain the movable closure element in a desired position.

The latch assembly may further include a second actuating assembly on the second side of the movable closure element and having normal release states. The second actuating assembly causes the catch block assembly to be moved from the engaged position into the disengaged position as an incident of the second actuating assembly changing from its normal state into its release state without requiring movement of the trip lever from its normal position into its release position.

In one form, the catch block assembly has a first post which is engaged by the second actuating assembly and repositionable by the second actuating assembly as the second actuating assembly is changed from its normal state into its release state to cause the catch block assembly to be changed from the engaged state into the disengaged state.

In one form, the catch block assembly has a post which is engaged by the trip catch and repositionable by the trip catch from the engaged position into the disengaged position as the catch block is changed from its first position into the second position.

The posts may be spaced from each other and each project in cantilevered fashion.

In one form, the second actuating assembly has an actuating handle that is pivotable between normal and release positions to thereby change the catch block assembly from the engaged position into the disengaged position.

In one form, the actuating handle has a projecting element/cantilevered connecting element that follows pivoting movement of the actuating handle and directly engages the catch block assembly.

In one form, the catch block assembly has a cantilevered post that engages the projecting element/cantilevered projecting element.

The invention further contemplates the above latch assembly in combination with a movable closure element to which the latching subassembly is mounted.

DETAILED DESCRIPTION OF THE DRAWINGS

Figure 1:
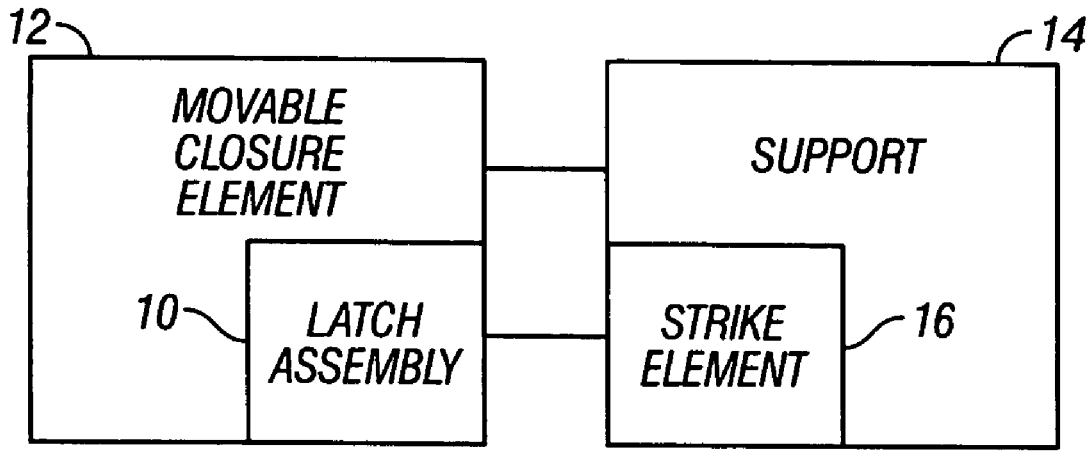
FIG. 1 is a schematic representation of a system including a latch assembly, according to the present invention, mounted upon a closure element which is movable relative to a support and which coacts with a strike element on the support to maintain the closure element in a desired position.

Referring initially to FIG. 1, a latch assembly 10, according to the present invention, is shown on a closure element 12 mounted upon a support 14. The closure element 12 is selectively movable relative to the support 14 between different positions. The latch assembly 10 cooperates with a strike element 16 on the support 14 to releasably maintain the movable closure element 12 in a desired position. The inventive latch assembly 10 is shown in a generic form in FIG. 1 since it can be used on virtually any type of movable closure element in any type of environment. One representative environment for the latch assembly 10 is upon a movable closure element 12 such as an access door, on a support 14 in the form of a piece of agricultural or construction equipment, such as a tractor. However, the latch assembly 10 can be used in other dynamic and static environments, with the operation thereof being substantially the same in each.

Figure 2:
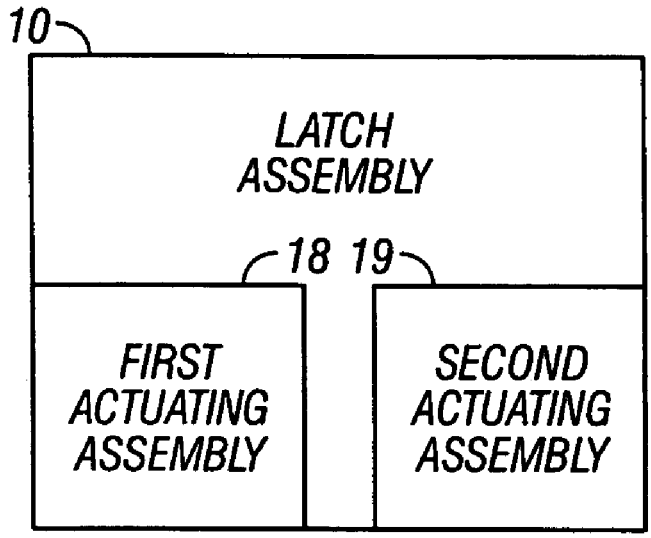
FIG. 2 is a schematic representation of the inventive latch assembly in FIG. 1 and showing first and second separate actuating assemblies therefor.
Figure 3:
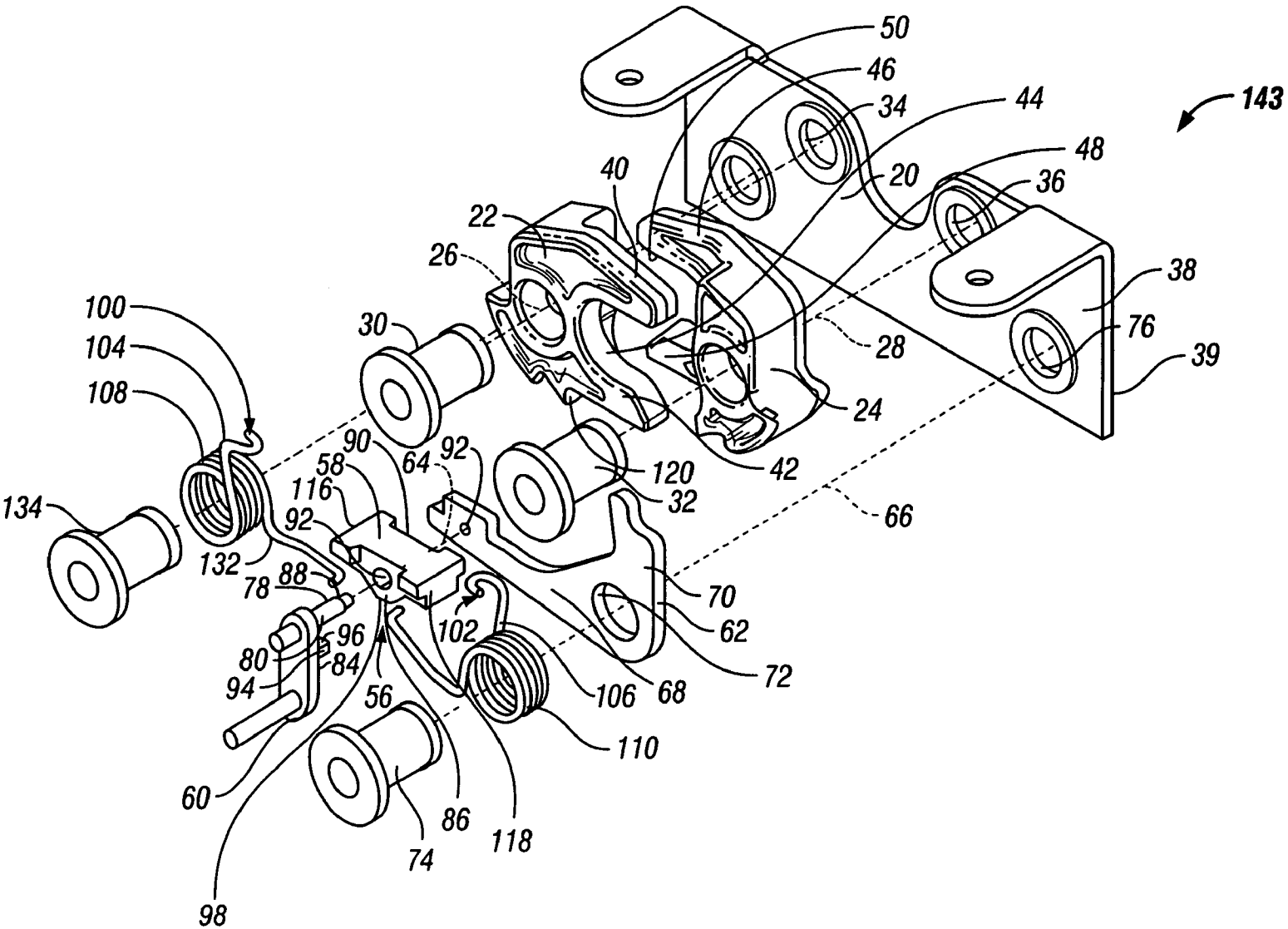
FIG. 3 is an exploded, perspective view of a latching subassembly on the latch assembly, according to the present invention, and including a pair of pivoting rotors.

As shown in FIG. 2, the latch assembly 10 is operable by first and second actuating assemblies 18, 19 provided on opposite sides of the movable closure element 12 for independent interior and exterior operation of the latch assembly 10. The first and second actuating assemblies 18, 19 will be described herein in one form. However, it should be understood that both of the actuating assemblies 18, 19 could have a substantially different form than the exemplary forms described herein.

The first and second actuating assemblies 18, 19 are part of an overall operating assembly which is responsible for causing the latch assembly 10 to release the strike element 16 to permit repositioning of the movable closure element 12 from a particular position therefor that is maintained with the latch assembly 10 holding the strike element 16. More particularly, as shown in FIGS. 3-7, the latch assembly 10 has a housing 20 to which a pair of cooperating rotors 22, 24 are mounted for pivoting movement about parallel axes 26, 28, respectively. The rotors 22, 24 may have the same construction, as shown, or a different construction. The rotors 22, 24 are mounted on the housing by axles 30, 32, which extend through openings 34, 36 in a housing wall 38 and are fixed by being deformed at an outer surface 39 of the wall 38. The rotors 22, 24 are journalled for rotation, one each, around the axles 30, 32.

The rotor 22 has a U-shaped free end with projecting legs 40, 42, which bound a throat 44. The rotor 24 has corresponding legs 46, 48 bounding a throat 50. The rotors 22, 24 are mounted upon the axles 30, 32 so as to cooperate in a scissors-type action as they each move between a release position, shown in FIG. 4, and a primary latched position, as shown in FIGS. 3 and 5-7. With the rotors 22, 24 in the release position of FIG. 4, movement of the rotors 22, 24 against the strike element 16, as by repositioning of the movable closure element 12, causes the strike element 16 to be directed in the direction of the arrow 51 in FIG. 4. The strike element 16 progressively cams the rotors 22, 24 so that they are pivoted in the direction of the arrows 52, 53 about their axes 26, 28, respectively. Continued movement of the strike element 16 against the rotors 22, 24 causes the legs 40, 42, 46, 48 to cooperatively fully surround an opening 54 within which the strike element 16 becomes captive with the rotors 22, 24 in their primary latched positions.

The rotors 22, 24 are maintained in their primary latched positions by a catch block assembly at 56 consisting of a catch block 58 and an adaptor 60, attached thereto and performing a function as hereinafter described. The catch block 58 is mounted to an L-shaped catch arm 62 for pivoting movement about an axis 64. The catch arm 62 is in turn mounted to the housing 20 for pivoting movement around an axis 66. The catch arm 62 has long and short legs 68, 70 at the juncture of which an opening 72 is formed to received a mounting axle 74 which is mounted in an opening 76 in the housing 20 and deformed where it is exposed at the surface 39 so as to be fixed thereto.

The adaptor 60 has a post 78 with a stepped diameter. A larger diameter portion 80 of the post 78 is guided within a bore 82 through the catch block 58. With a flat surface 84 at the base of the post 78 abutting to a surface 86 on the catch block 58, a reduced diameter portion 88 of the post 78 projects beyond the catch block surface 90 facing oppositely to the surface 86, and fixedly into a bore 92 adjacent to the free end of the long leg 68 of the catch arm 62. The adaptor 60 has a tab 94 projecting in the same direction as the post 78 from the adaptor surface 84 and having an upwardly facing surface 96 which bears on a flat, downwardly facing surface 98 on the catch block 58 so as to prevent pivoting movement of the adaptor 60 relative to the catch block 58. Resultingly, the adaptor 60 and catch block 58 move together as one piece in operation.

The rotors 22, 24 are biased about their respective axes 26, 28 by free ends 100, 102 of projecting arms 104, 106 on coil torsion springs 108, 110. The free end 100 of the spring 108 continuously exerts a bias on a shoulder 112 on the rotor 22, thereby urging the rotor 22 in a counterclockwise direction around the axis 26 in FIG. 4 towards the release position. The arm 102 on the spring 110 acts in like manner on a shoulder 114 on the rotor 24 to urge the rotor 24 in a clockwise direction about its axis 28 in FIG. 4 towards its release position.

Figure 4:
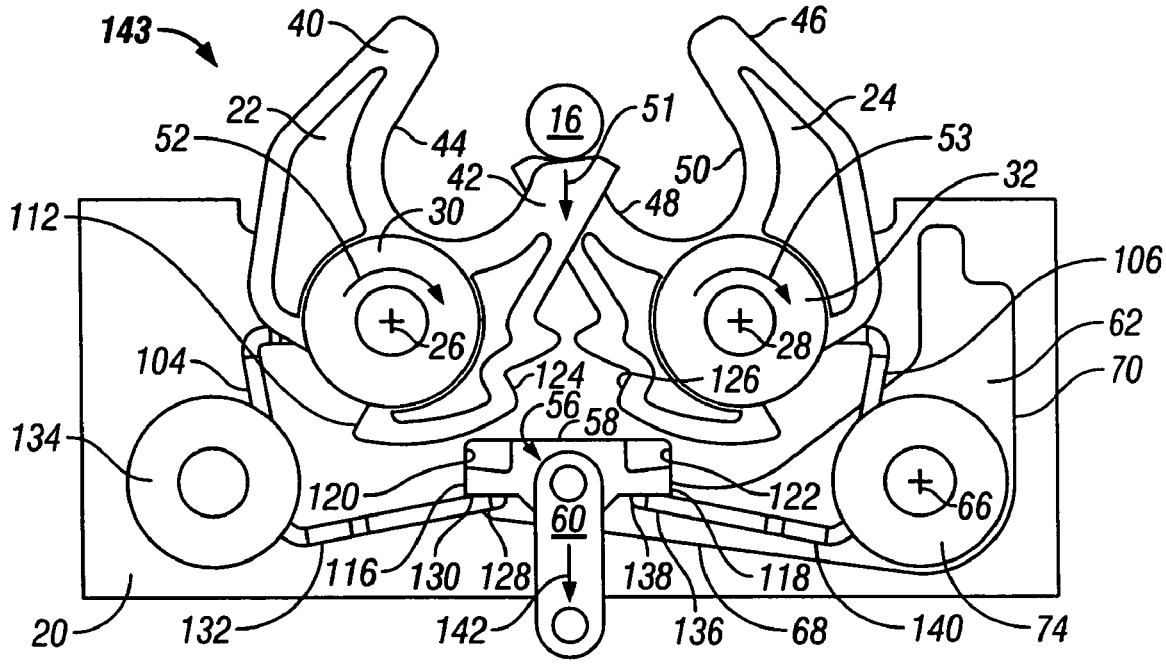
FIG. 4 is side elevation view of the latching subassembly in FIG. 3 with the rotors in a release position.
Figure 5:
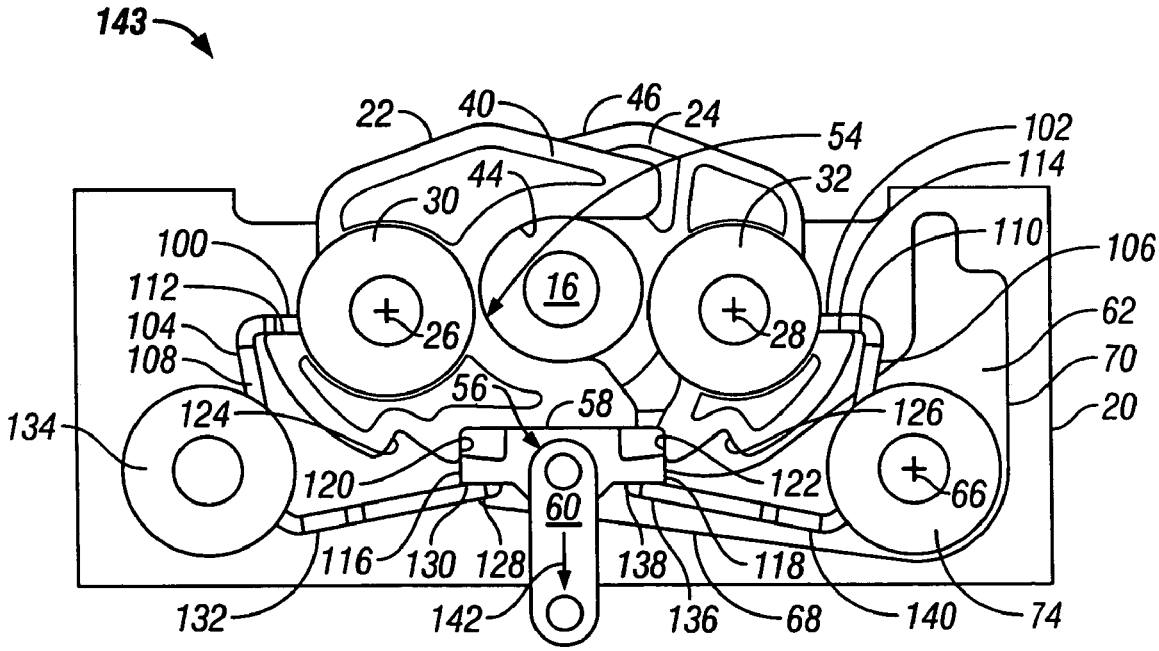
FIG. 5 is a view as in FIG. 4 with the rotors in a latched position.

The rotors 22, 24 are maintained in their primary latched positions in FIG. 5 by oppositely facing catch block surface 116, 118, which bear bearing respectively on stop surfaces 120, 122 on the rotors 22, 24, respectively. Separate stop surfaces 124, 126 on the rotors 22, 24 bear against the catch block surfaces 116, 118 to maintain the rotors 22, 24 in a secondary latched position (not shown), which is between the primary latched position of FIG. 5 and the release position of FIG. 4.

The springs 108, 110 are also responsible for cooperatively bearing the catch block assembly 56 upwardly to against the rotors 22, 24. More specifically, the free end 128 of the spring 108 opposite to the free end 100 bears on a downwardly facing shoulder 130. The free end 128 is at the extremity of an arm 132 projecting from the coiled portion of the spring 108 which surrounds an axle 134. Similarly, the free end 136 of the spring 110, opposite to the free end 102 of the spring 110 bears upon a shoulder 138 on the catch block 58. The free end 136 is carried on an arm 140 projecting from the coiled portion of the spring 110 which is supported on the axle 74, which additionally guides pivoting movement of the catch arm 62.

Figure 6:
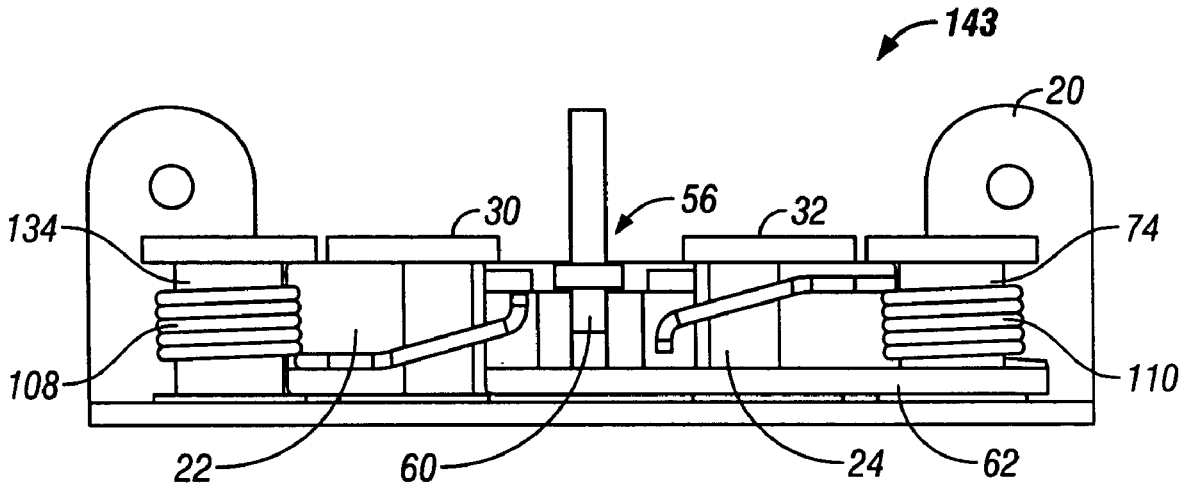
FIG. 6 is a front elevation view of the latching subassembly in FIG. 5.
Figure 7:
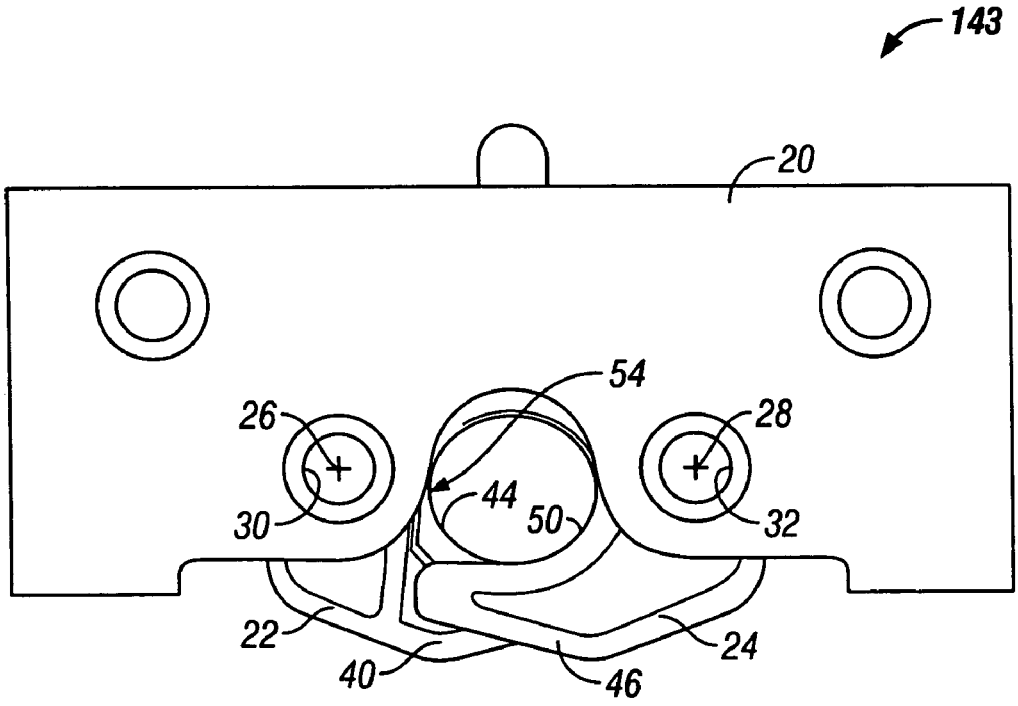
FIG. 7 is an inverted view of the latching subassembly from the side opposite that in FIG. 5.

In operation, with the rotors 22, 24 in their release position of FIG. 4, movement of the strike element 16 against the rotors 22, 24, by reason of repositioning of the movable closure element 12, cams the rotors 22, 24 simultaneously from the FIG. 4 release position towards the latched position of FIGS. 5-7. As this occurs, the catch block assembly 56 is urged against the moving rotor 22, 24 until the catch block assembly 56 aligns with the stop surfaces 124, 126 thereon. The movable closure element 12 can be maintained in the previously described, secondary latched position if the strike element 16 is not caused to be urged with any additional force against the rotors 22, 24. Continued movement of the closure element 12 ultimately causes the catch block assembly 56 to align with the stop surfaces 120, 122 and to be driven upwardly into confronting relationship therewith so that the rotors 22, 24 are each maintained in their primary latched positions.

When it is desired to reposition the movable closure element 12, the catch block assembly 56 has to be moved in translation downwardly, in a linear path in the direction of the arrow 142 (FIG. 5), until the catch block assembly 56 clears the stop surfaces 120, 122, whereupon the springs 108, 110 urge the rotors 22, 24 back towards their release positions. Because the catch block assembly 56 is allowed to pivot/float around the axis 64, the angular orientation of the catch block assembly 56 relative to the catch arm 62 can be consistently maintained as it is moved downwardly in the direction of the arrow 142. This avoids binding between the catch block 56 and rotors 22, 24.

The housing 20 and components mounted thereto, together define a latching subassembly 143. According to the invention, the operation of the latching subassembly 143, by repositioning of the catch block assembly 56, can be directly accomplished independently through either of the first and second actuating assemblies 18, 19. The details of the first actuating assembly 18 are shown in FIGS. 8-17. The first actuating assembly 18 consists of a trip lever 144 which is mounted for pivoting movement relative to a mounting plate 146, that is fixed to the housing 20 through the axles 30, 32. The latching subassembly 143 and the first actuating assembly 18 are thus joined as a combined subassembly that can be assembled to, and disassembled from, the movable closure element 12 and the second operating assembly 19. The trip lever 144 has an elongate operating portion 148 at one end and is bifurcated at its opposite end to define spaced legs 150, 152 which are received between spaced ears 154, 156 on the mounting plate 146. The legs 150, 152 in turn straddle a trip latch 158. A pin 160 extends through the trip lever 144, trip latch 158, and the ears 154, 156 to maintain the same in operative relationship wherein the trip lever 144 and trip latch 158 are pivotable about a common axis 162 defined by the pin 160. The axis 162 resides in a plane that does not extend through the closure element 12.

The trip latch 158 has a shoulder 164 which bears against a surface 166 defined by a post 168 that is a extension of the post 78 on the adaptor 60 through which the catch block 58 is mounted. The post 168 projects in cantilever fashion. By pivoting the trip latch 158 in a counterclockwise direction, as indicated by the arrow 170 in FIG. 16, the trip latch shoulder 164 bears against the post surface 166 and drives the catch block assembly 56 in the direction of the arrow 142 in FIGS. 5 and 16 from its engaged position into its disengaged position. The pivoting movement of the trip latch 158 is imparted by the trip lever 144 by pivoting the trip lever 144 about the pin 160 and its axis 162 in the same counterclockwise direction as indicated by the arrow 170 in FIG. 16. The trip latch 158 has side extensions 172, 174 which define shoulders 176, 178, respectively, which confront shoulders 180, 182 on the trip lever legs 150, 152, respectively. The shoulders 180, 182 on the trip lever 144 drive the shoulders 176, 178 to pivot the trip latch 158 as the trip lever 144 is pivoted by the operator. The trip lever 144 and trip latch 158 could actually be formed to move as one piece to perform the function stated.

The trip lever 144, in this particular embodiment, is mounted so as to be operable by a squeezing force. More particularly, the operating portion 148 of the trip lever 144 is associated with a hollow, tubular, graspable handle 184 so that the handle 184 can be surrounded by a hand in such a manner as to permit grasping by the operator's fingers of the operating part 148 of the trip lever 144 and simultaneously the repositioning of the movable closure element 12 through the handle 184. The trip lever 144 is slid into a slot 186, originating at one end 188 of the handle 184. The slot 186 has a width W that is slightly greater than the width W1 of the operating part 148 of the trip lever 144. The slot length L is chosen so that the free end 190 of the trip lever 144, remote from the mounting legs 150, 152, can pass through the slot 186 as the trip lever 144 is pivoted in operation.

The trip lever 144 has oppositely projecting tabs 192 (one shown). The trip lever 144 is directed into the slot 186 so that the tabs 192 reside within the hollow 194 of the tubular handle 184. The tabs 192 effectively increase the width of the trip lever 144 thereat to a dimension that is greater than the width W. Accordingly, the trip lever 144 must be slid into the hollow 194 of the tubular handle 184 leading with the free end 190. The tabs 192 confine outward pivoting of the trip lever 144 relative to the handle 184.

A leaf spring 196 (FIG. 15) acts between the trip lever 144 and the inside surface 198 of the tubular handle 184 to normally urge the operating portion 148 of the trip lever 144 out of the slot 186 into a normal position. With the user grasping the tubular handle 184 in the vicinity of the trip lever 144, the fingers can be wrapped around the exposed edge 200 of the trip lever 144 and drawn towards the palm in a squeezing action to move the trip lever 144 from a normal position into a release position, as shown in phantom lines in FIG. 15 corresponding to normal and release states for the first actuating assembly 18. As the trip lever 144 is moved from the normal position into the release position, the trip latch 158 is pivoted in turn to move the catch block assembly 56 from its engaged position into its disengaged position.

The tubular handle 184 is maintained in its operative position by directing a mounting bolt 202 through a bore 204 in a flange 206 on the mounting plate 146 and into a threaded receptacle 208 on a U-shaped spring clip 210 and which is maintained within the hollow 194 by sliding the U-shaped spring clip 210 over the tubular handle end 188.

The opposite end 212 of the tubular handle 184 is mounted to the closure element 12 through an elbow-shaped fitting 214. The fitting 214 has a male end portion 216 which fits slidably within the hollow 194 at the handle end 212. An annular shoulder 218 abuts to the handle end 212 with the fitting 214 fully seated. The fitting 214 has a flange 220 which seats on one side 222 of the movable closure element 12 and has a threaded bore 224 to accept a mounting bolt 226.

A protective shroud 228, made of plastic, or the like, can be slid over the housing 20 and the components mounted thereto, i.e. the latching subassembly 143, the mounting plate 146, the trip latch 158, and the adjacent portions of the tubular handle 184 and trip lever 144. The shroud 228 has a slot 230 to accept the tubular handle 184 and an opening 232 through which the rotors 30, 32 are exposed to permit engagement with the strike element 16. The shroud 228 is maintained in its operative position by connection to the mounting plate 146 through screws 234.

Figure 8:
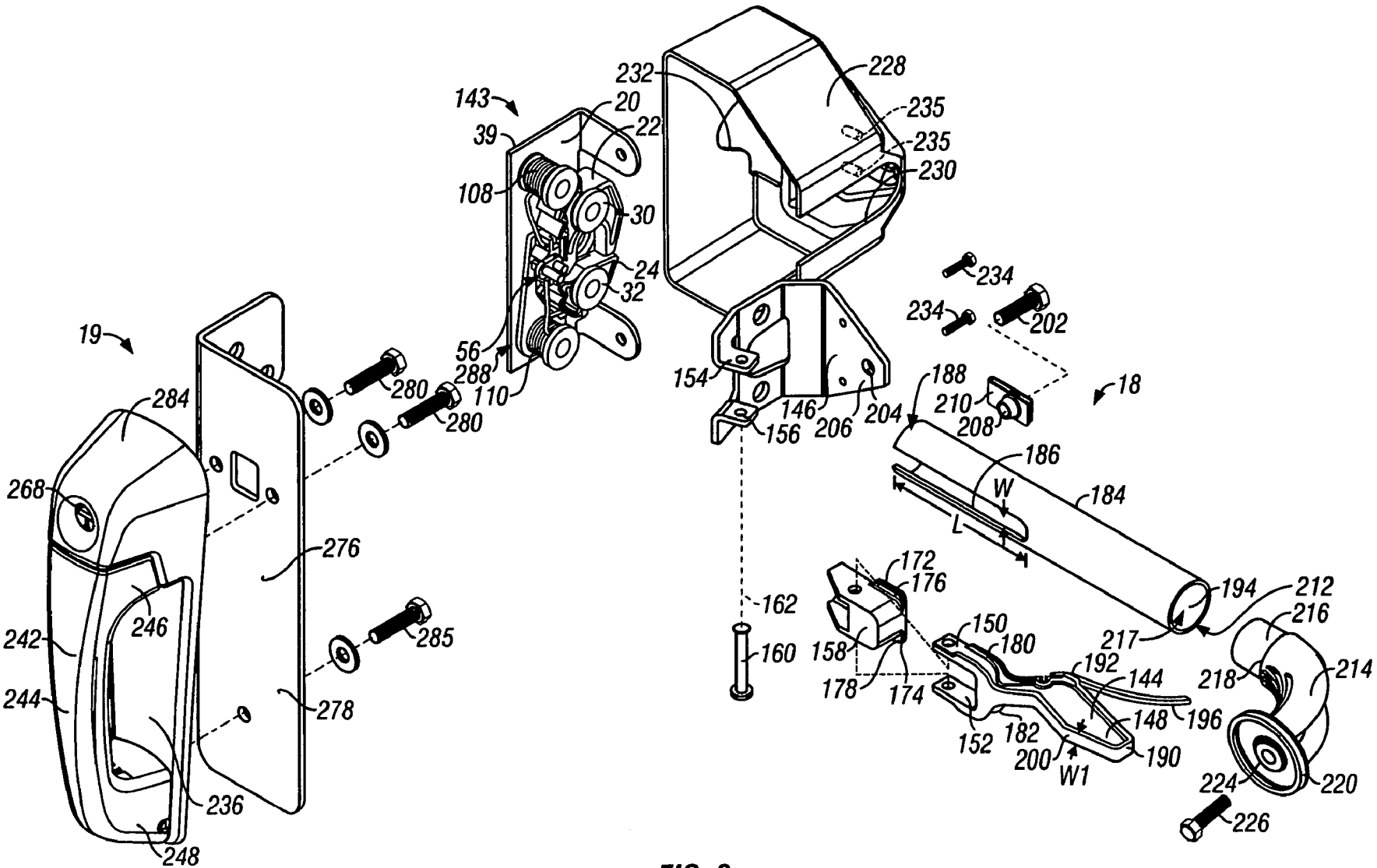
FIG. 8 is an exploded, perspective view of the inventive latch assembly including the latching subassembly and first and second actuating assemblies for operating the latching subassembly.
Figure 9:
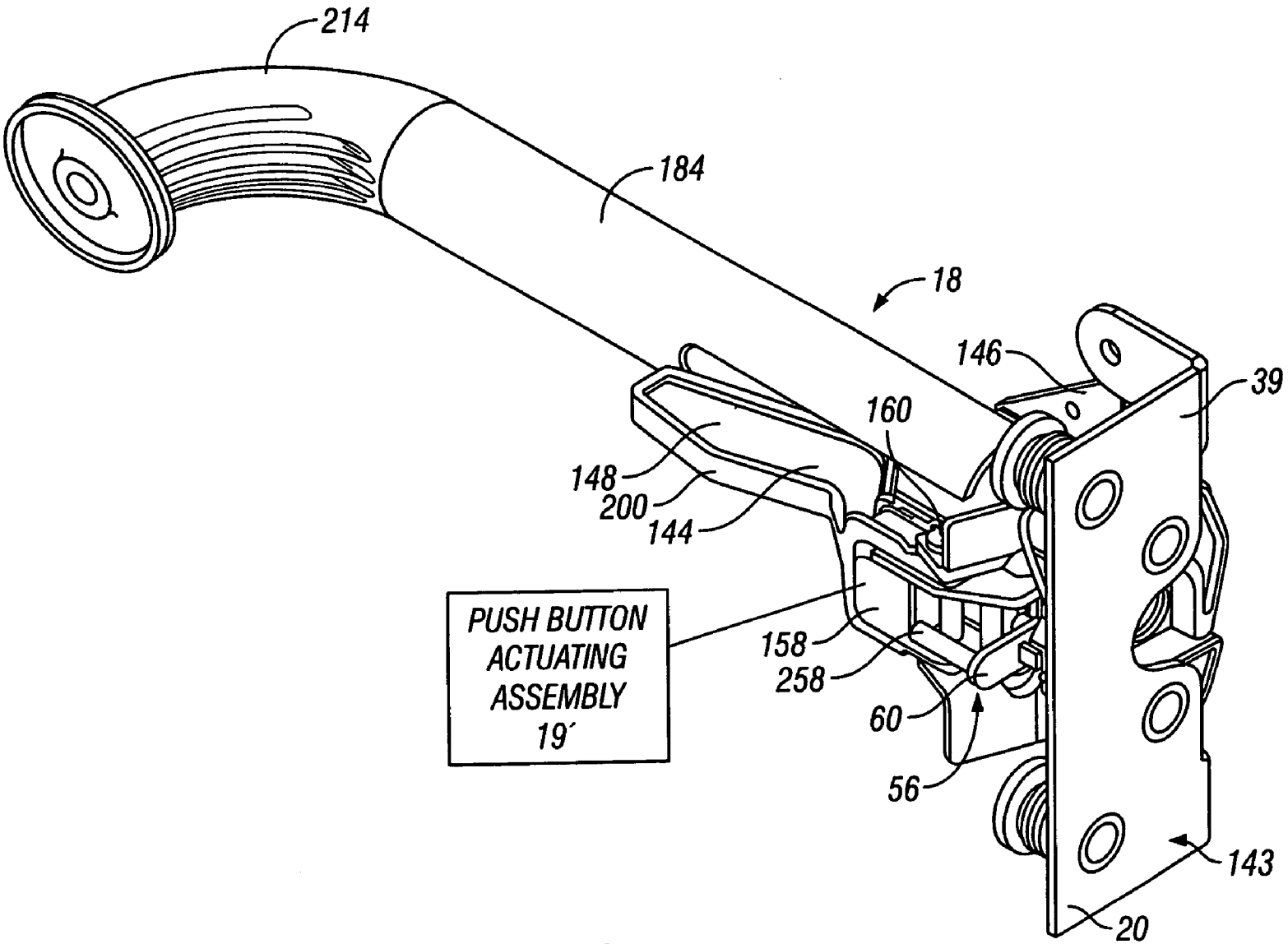
FIG. 9 is a rear perspective view of a combined subassembly including a first of the actuating assemblies in FIG. 8 and the latching subassembly in FIGS. 3-7.
Figure 10:
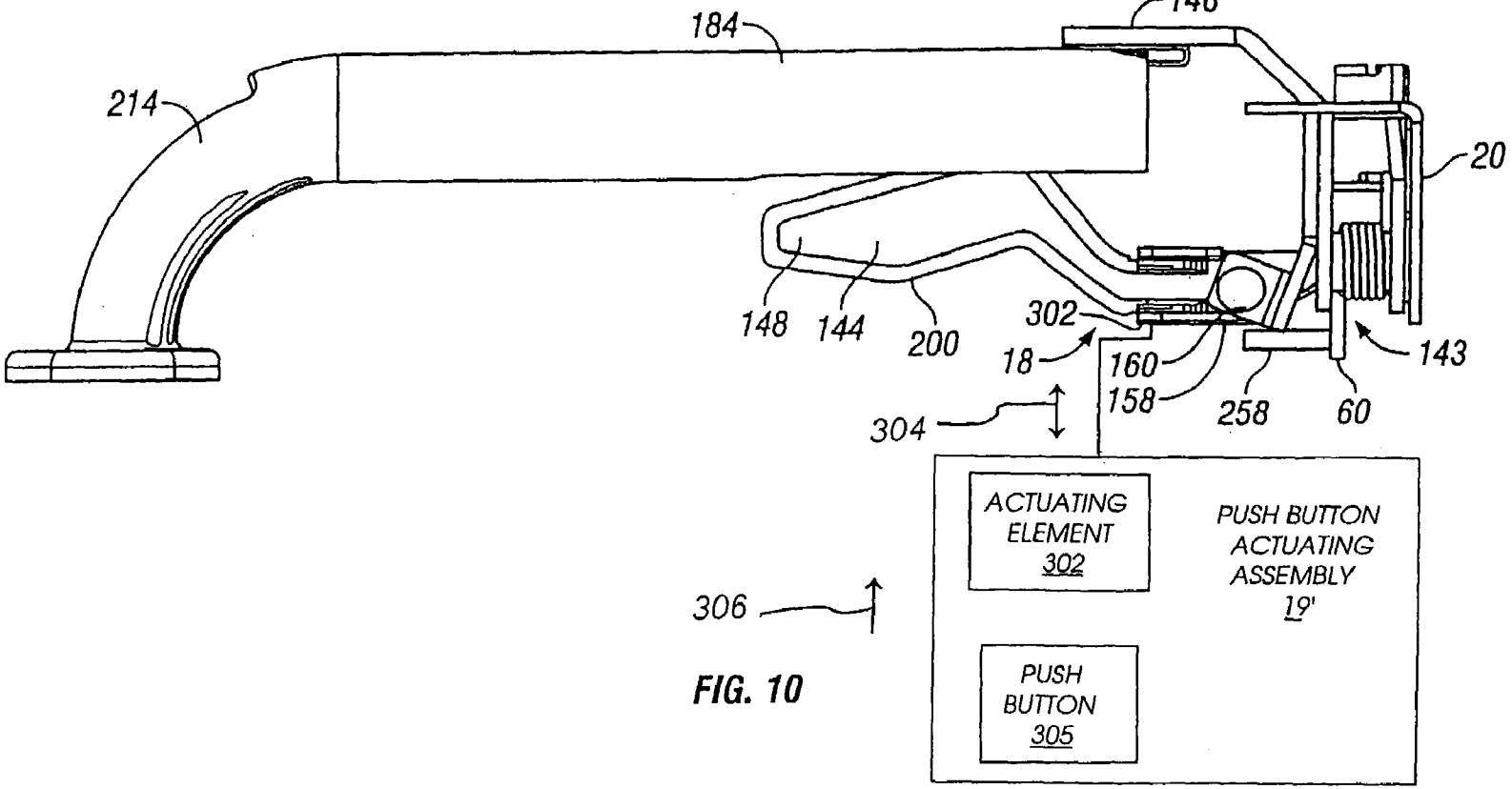
FIG. 10 is a plan view of the combined subassembly of FIG. 9.
Figure 11:
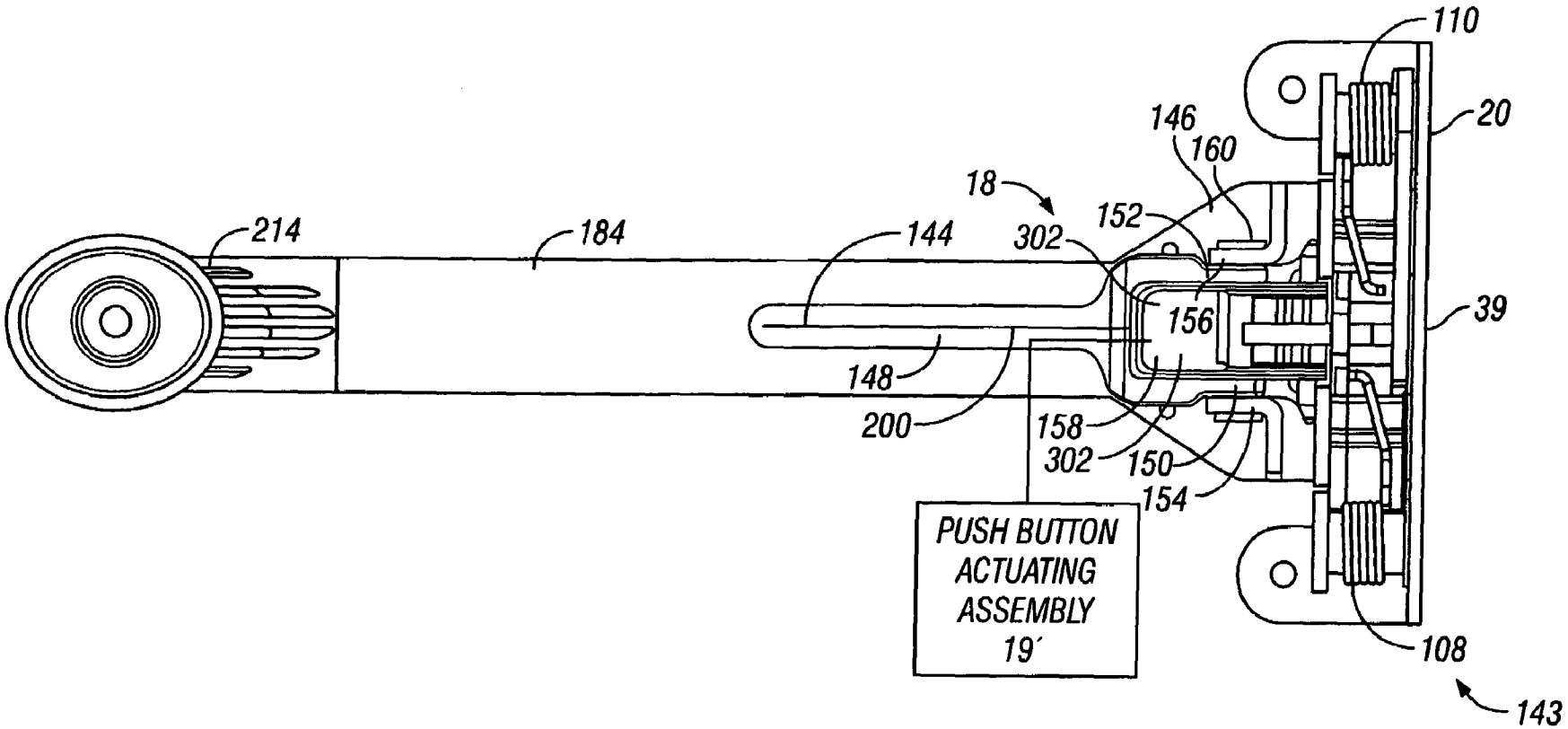
FIG. 11 is a front elevation view of the combined subassembly of FIGS. 9 and 10.
Figure 12:
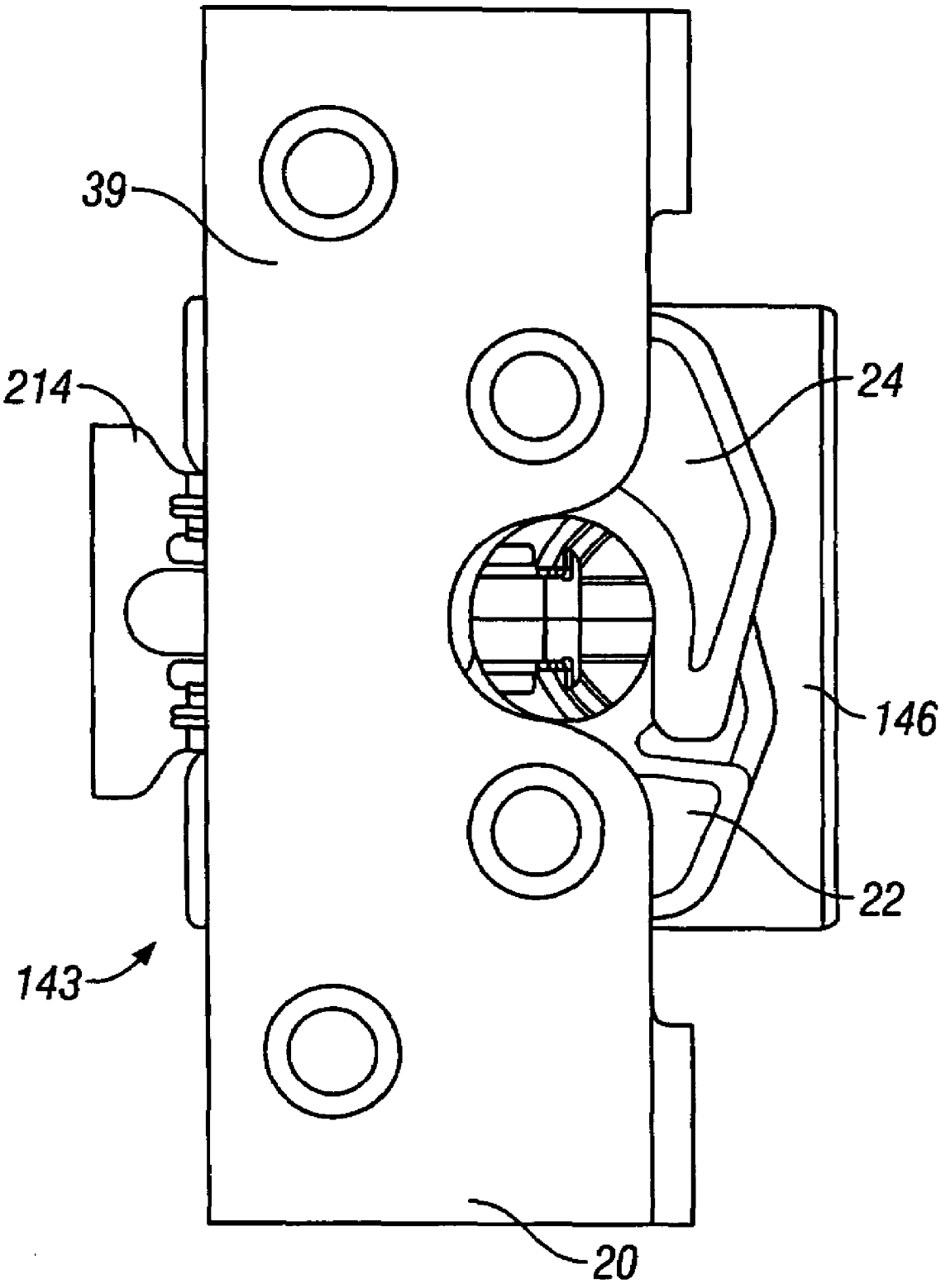
FIG. 12 is an side elevation view of the combined subassembly of FIGS. 9-11.
Figure 13:
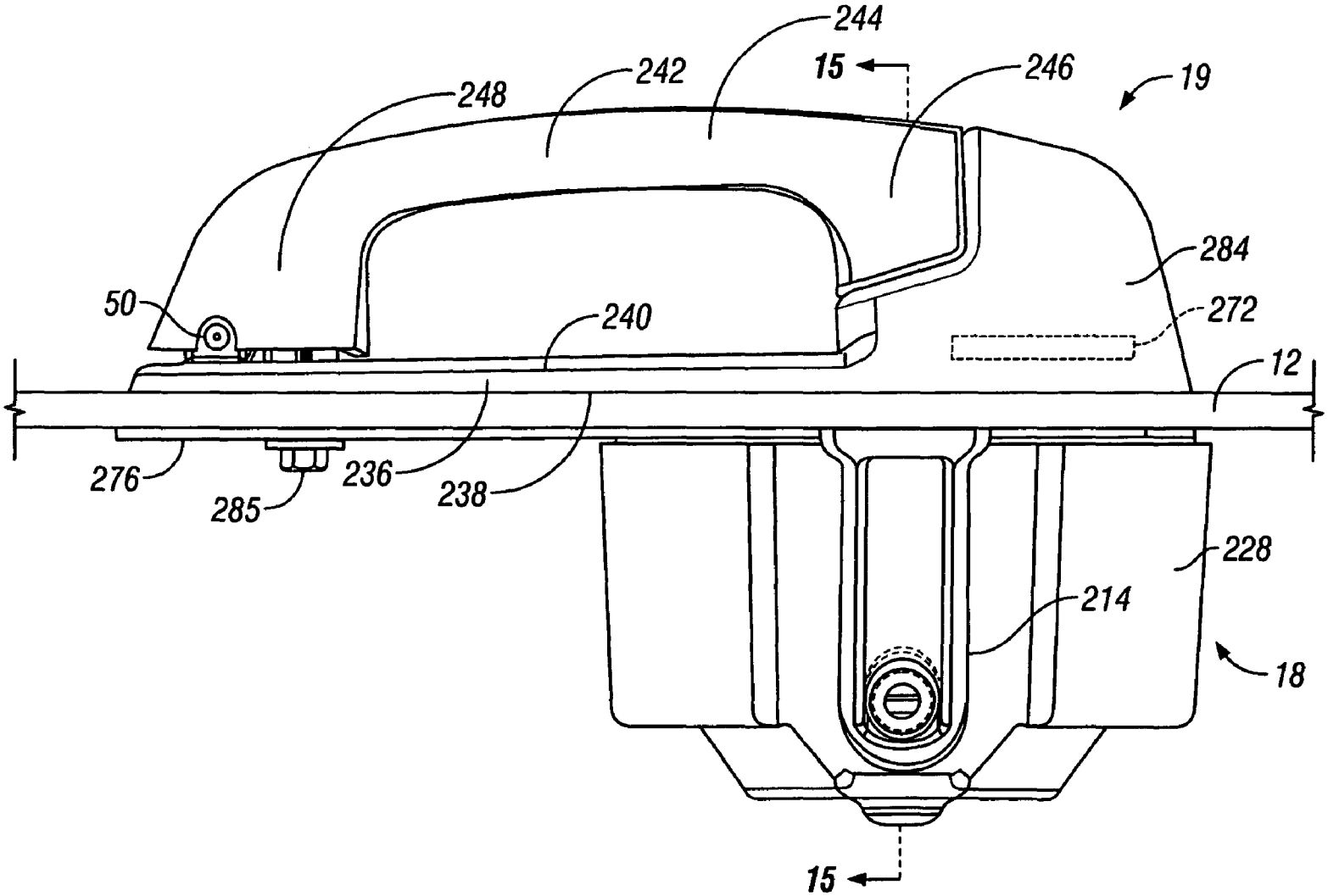
FIG. 13 is a side elevation view of the inventive latch assembly assembled to a section of a movable closure element and with a protective shroud placed over the combined subassembly of FIGS. 9-12.
Figure 15:
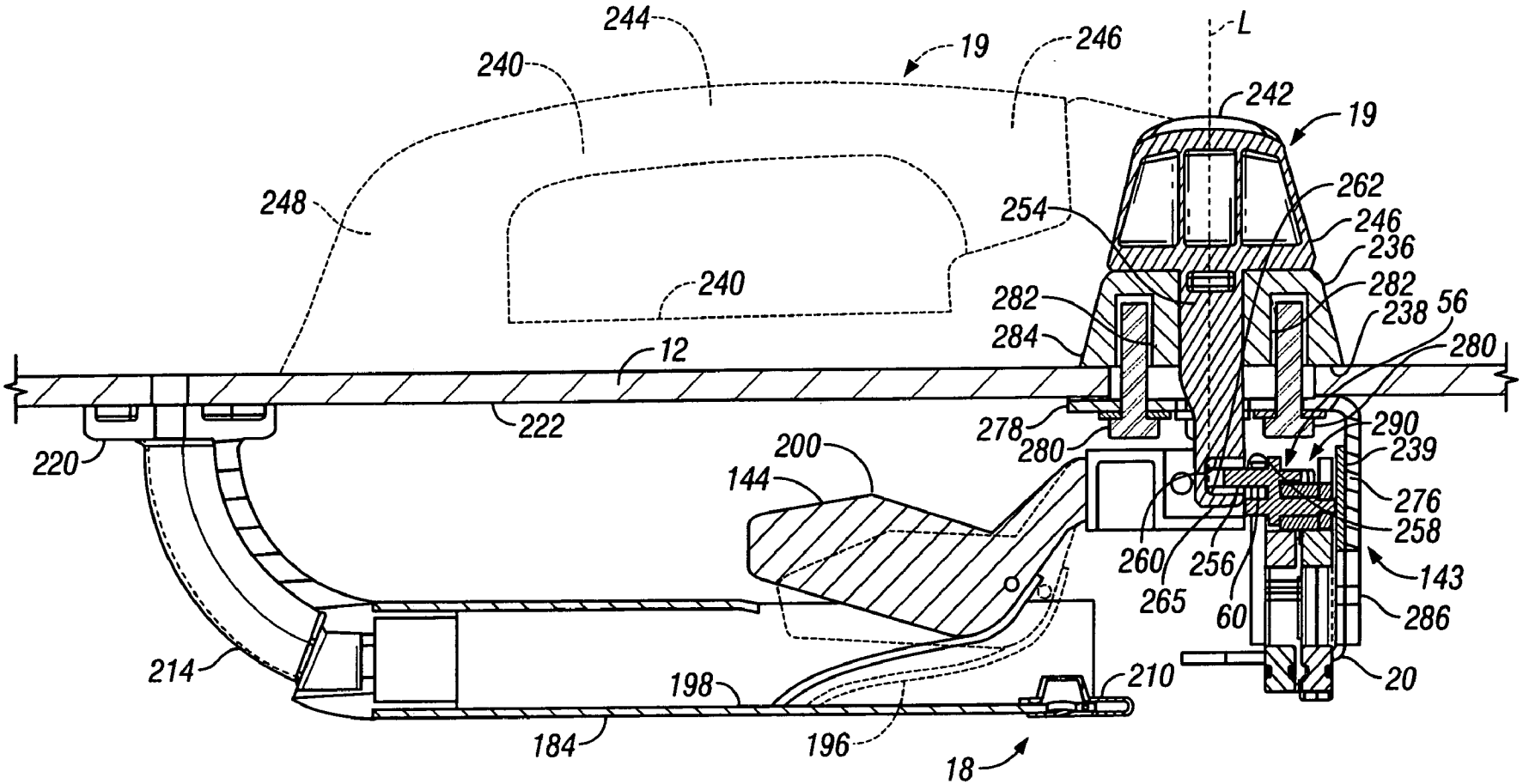
FIG. 15 is a cross-sectional view of the latch assembly taken along line 15-15 of FIG. 13 with the protective shroud removed from the combined subassembly and with one of the actuating subassemblies shown in an alternative mounting orientation in dotted lines.
Figure 16:
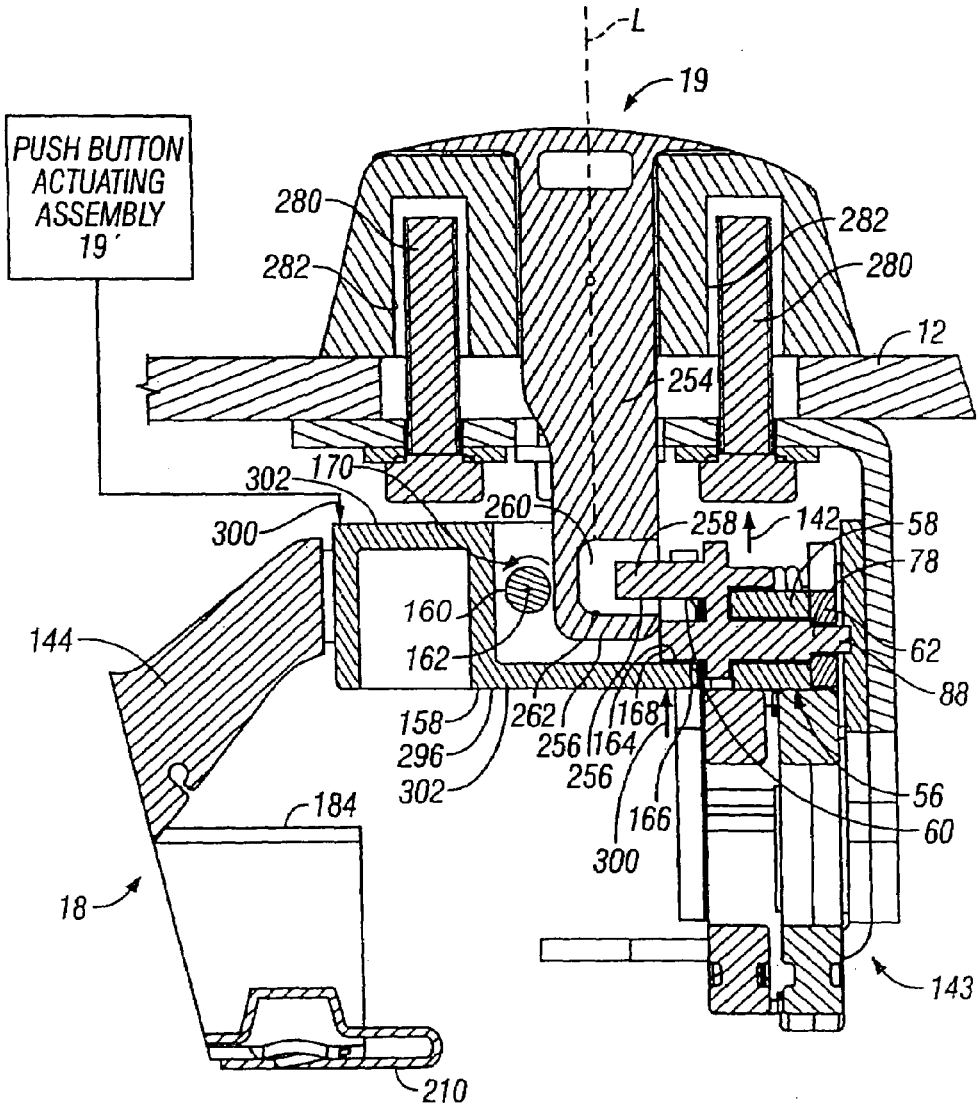
FIG. 16 is an enlarged, fragmentary view of a portion of the latch assembly as shown in cross-section in FIG. 15.
Figure 17:
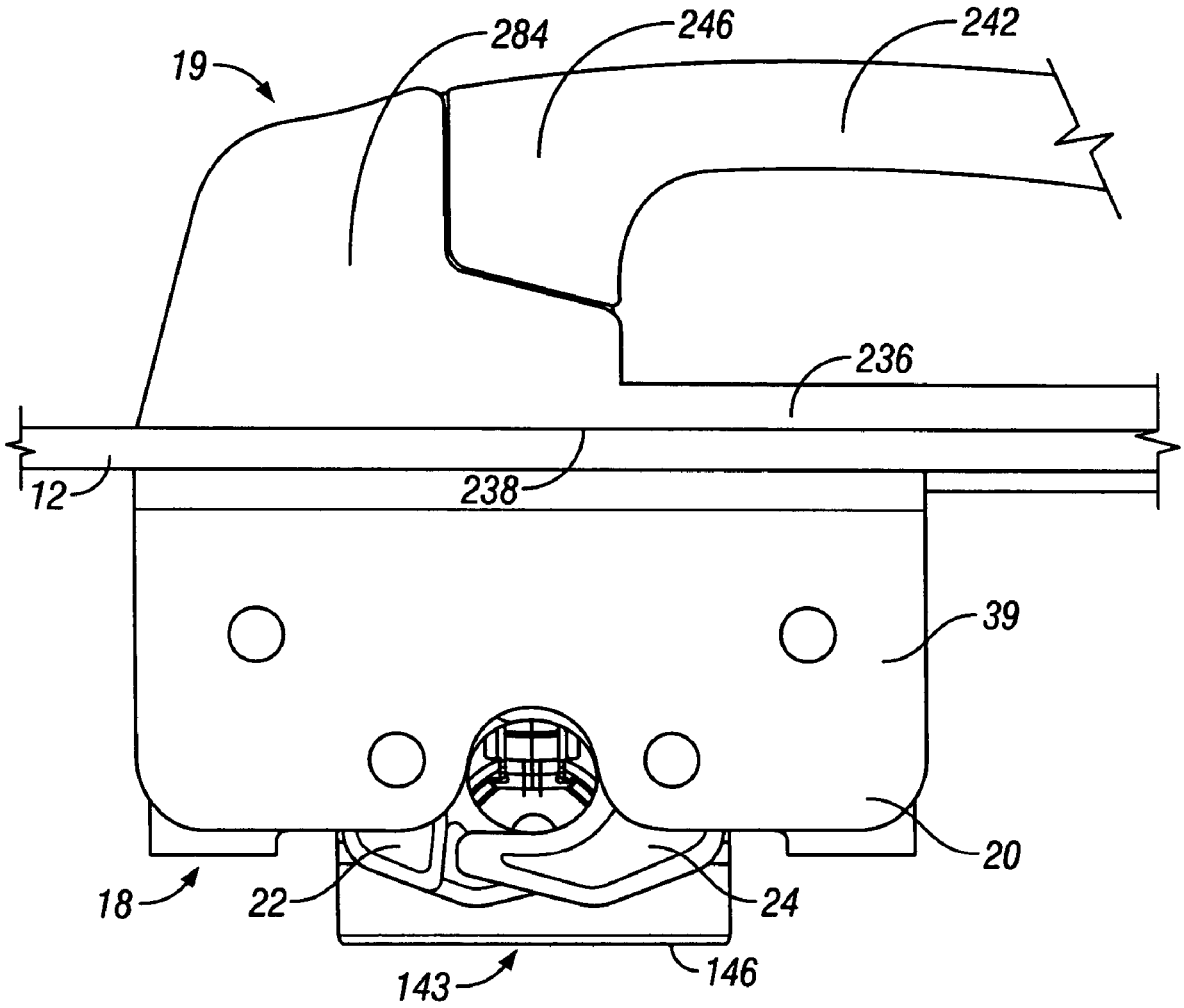
FIG. 17 is a fragmentary, side elevation view of the latch assembly in FIGS. 13-16.
Figure 18:
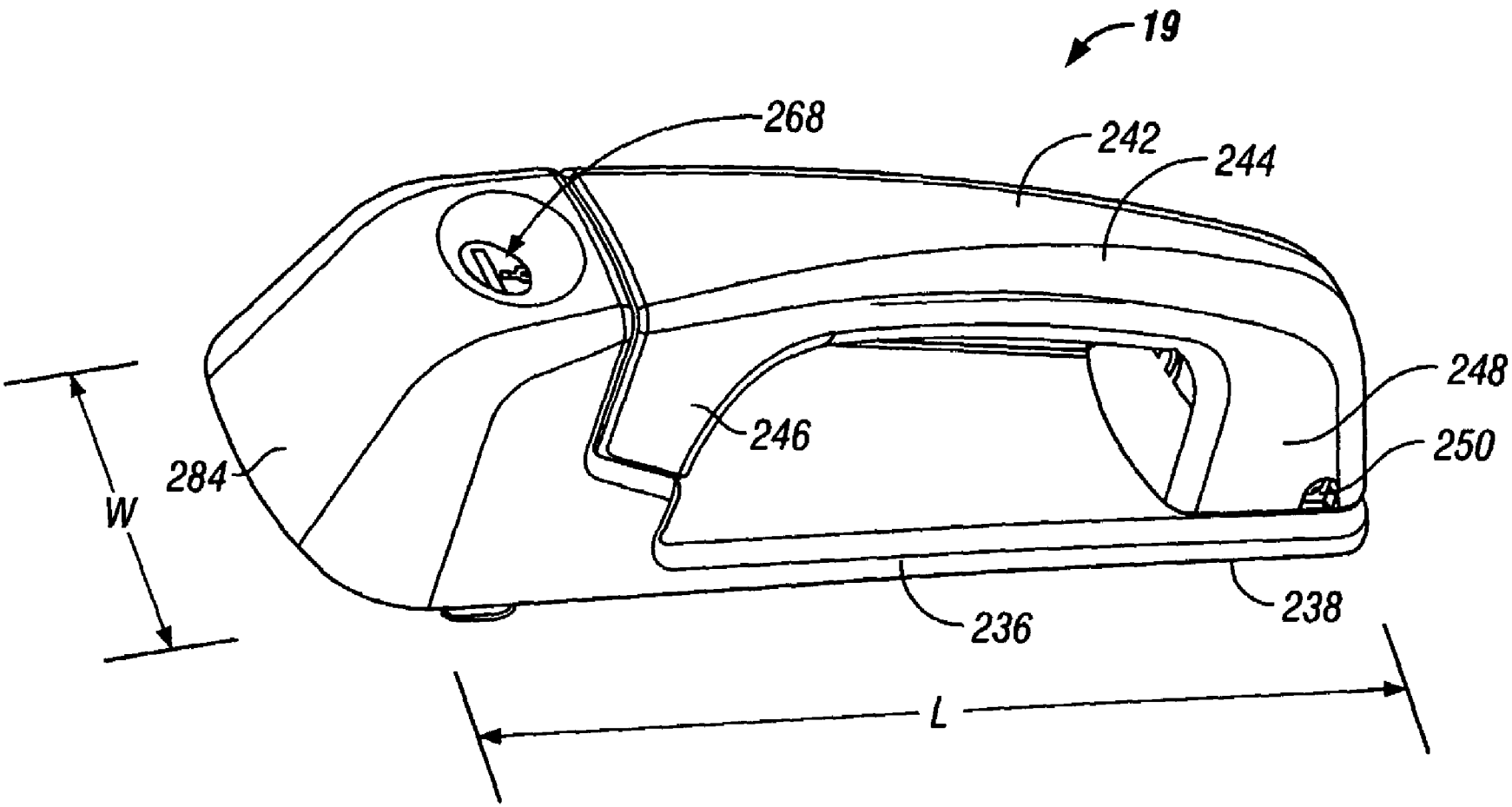
FIG. 18 is a perspective view of a second actuating assembly for placement on the side of a movable closure element opposite that to which the first latch assembly shown in FIGS. 9-12 is located with one form of locking assembly.
Figure 19:
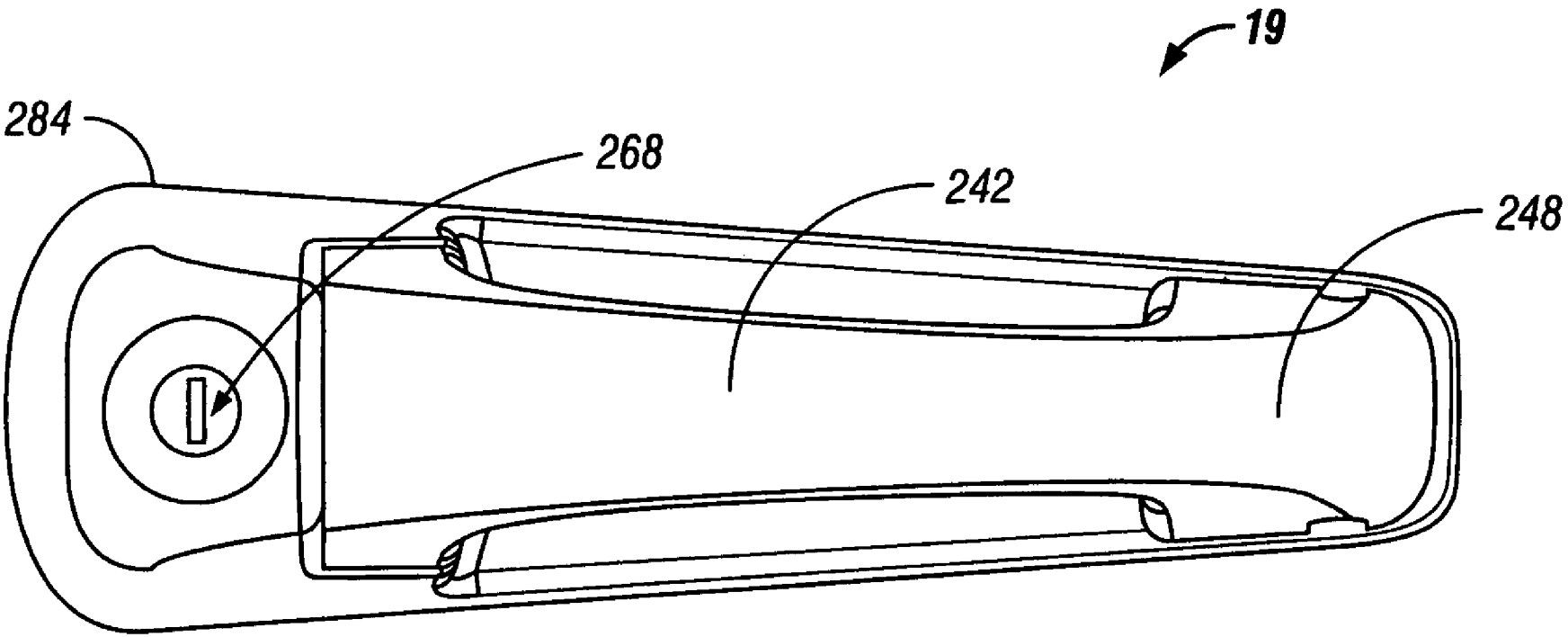
FIG. 19 is a front elevation view of the second actuating assembly in FIG. 18.

Details of the second actuating assembly 19 are shown in FIGS. 8, 13, and 15. The second actuating assembly 19 consists of a mounting base 236 defining a flat mounting surface 238 which can be facially placed against the flat, second side 240 of the movable closure element 12. The mounting surface 238 extends over substantially the entire length (L) and width (W) dimension of the mounting base 236. An actuating handle 242 is pivotably attached to the base 236. The actuating handle 242 is U-shaped with a graspable base 244 and spaced first and second legs 246, 248. The leg 248 is pivotably connected to the base 236 through a pin 250 for pivoting movement around an axis 252 residing in a plane that does not extend through the closure element 12. Through a spring assembly 253, the actuating handle 242 is urged towards its normal position, as seen in solid lines in each of FIGS. 13, 15 and 17-22. More preferably, once the actuating handle 242 is operated, the biased catch block 58 loads the springs 108, 110 so that the springs 108, 110 urge the catch block 58 in a manner that causes the actuating handle 242 to be moved back towards its normal position, once the actuating force thereon is released. This obviates the need for the spring assembly 253.

The leg 246 has a projecting element/cantilevered connecting element 254 which moves as one piece with the leg 246. The projecting element/cantilevered connecting element 254 projects past the mounting surface 238 and is configured to engage a surface 256 defined by a cantilevered post 258 on the adaptor 60 on the catch block assembly 56. The post 258 is spaced from, and longer than, the post 168.

The projecting element/cantilevered connecting element 254 directly engages the post 258. The projecting element/cantilevered connecting element 254 has an opening 260 formed therein into which the post 258 projects with the second actuating assembly 19 in operative position.

Figure 20:
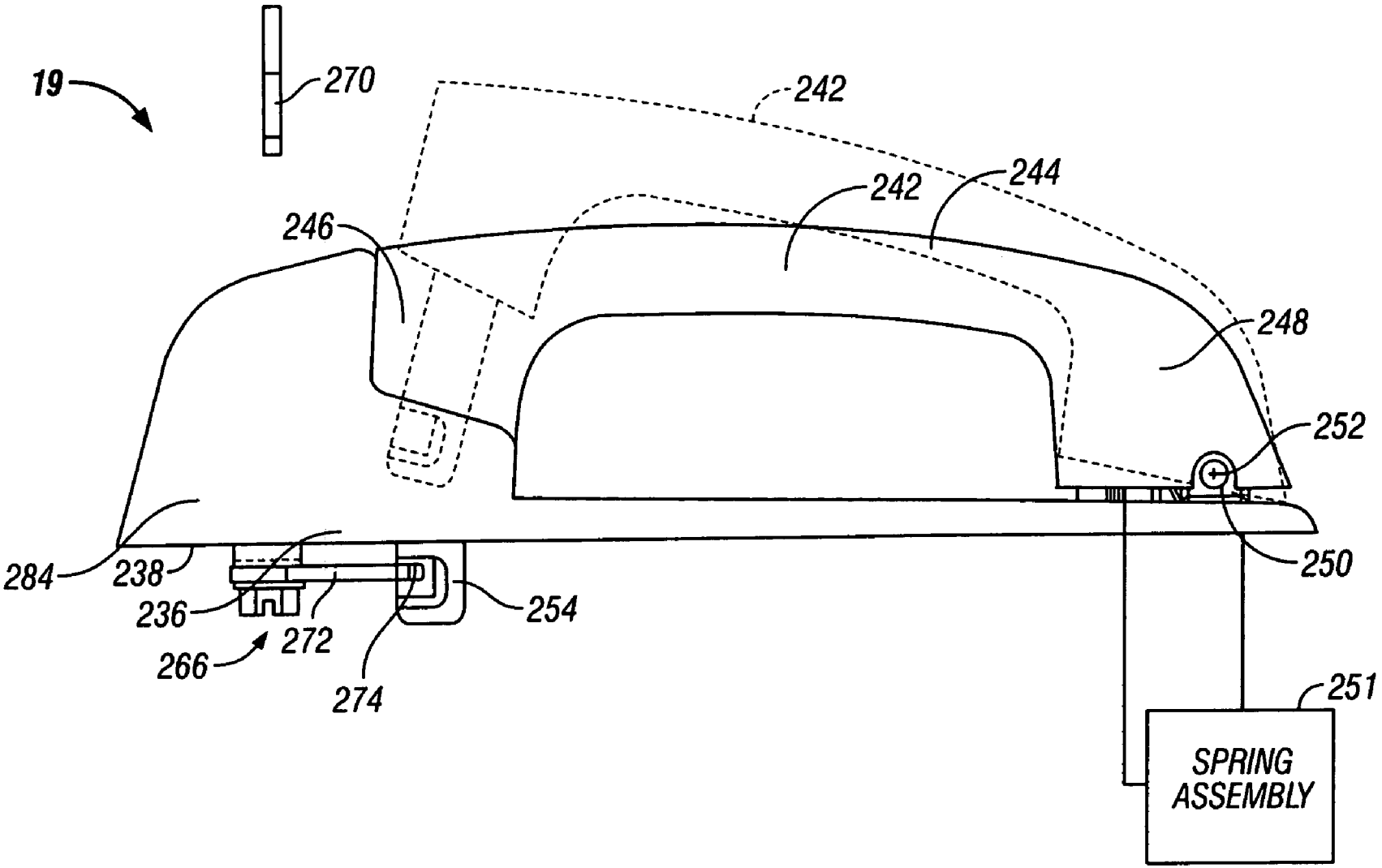
FIG. 20 is a plan view of the second actuating assembly in FIGS. 18 and 19.
Figure 21:
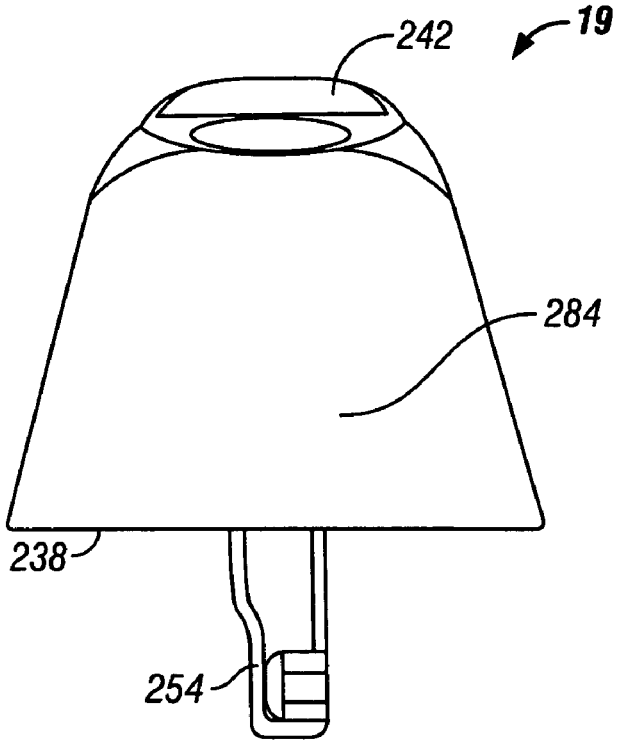
FIG. 21 is a side elevation view of the second actuating assembly in FIGS. 18-20.
Figure 22:
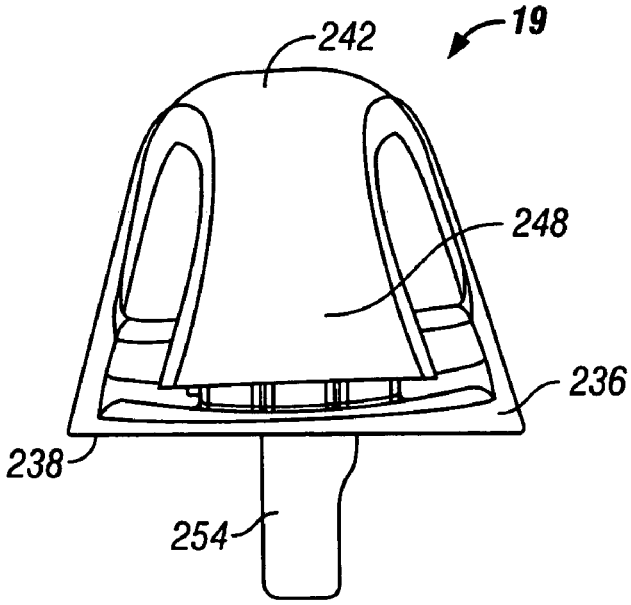
FIG. 22 is an elevation view of the second actuating assembly in FIGS. 18-21 from the side opposite that in FIG. 21.

The actuating handle 242 is changeable between the normal position, shown in FIGS. 13, 15, and 17-22 and a release position, as shown in phantom in FIG. 20 to change the second actuating assembly 19 from a normal state into a release state. As the actuating handle 242 is changed from the normal position into the release position, the shoulder 262 bounding the opening 260 in the projecting element/cantilevered connecting element 254, bears upon the post 258, thereby drawing the catch block assembly 56 in the direction of the arrow 142 so as to thereby change the catch block assembly 56 from its engaged position into its disengaged position. The opening 260 is configured so that the post 258 can be directed thereinto to coact with the shoulder 262 with the first and second actuating assemblies 18, 19 in a range of relative positions without the need for separate fasteners acting between the post 258 and projecting element/cantilevered projecting element 254. More specifically, the first and second actuating assemblies 18, 19 can be relatively repositioned about a line L through the length of the projecting element/cantilevered projecting element 254 through a range of preferably at least 90°. The relationship of the pivot axes 162 and 252, for the trip lever 144 and actuating handle 242, respectively, varies as this occurs between parallel and orthogonal. This allows the length of the actuating handle 242 to be oriented selectively horizontally and vertically. This is made possible by forming the opening 262 by cutting out the projecting element/cantilevered connecting element 254 over a substantial portion of its periphery yet while maintaining the free end 265 defining the shoulder 262 rigidly upon the projecting element/cantilevered connecting element 254.

The second actuating assembly 19 has a lock assembly at 266 which has a key operated cylinder 268. By directing a key 270 into the cylinder 268, the cylinder 268 can be rotated to reposition a locking tab 272 between locked and unlocked states. In the locked state, the locking tab 272 is directed into a slot 274 in the projecting element/cantilevered connecting element 254 so as to prevent pivoting of the handle 242 as to draw the projecting element/cantilevered connecting element 254 along the line L to resituate the catch block assembly 56 in the disengaged position.

Figure 14:
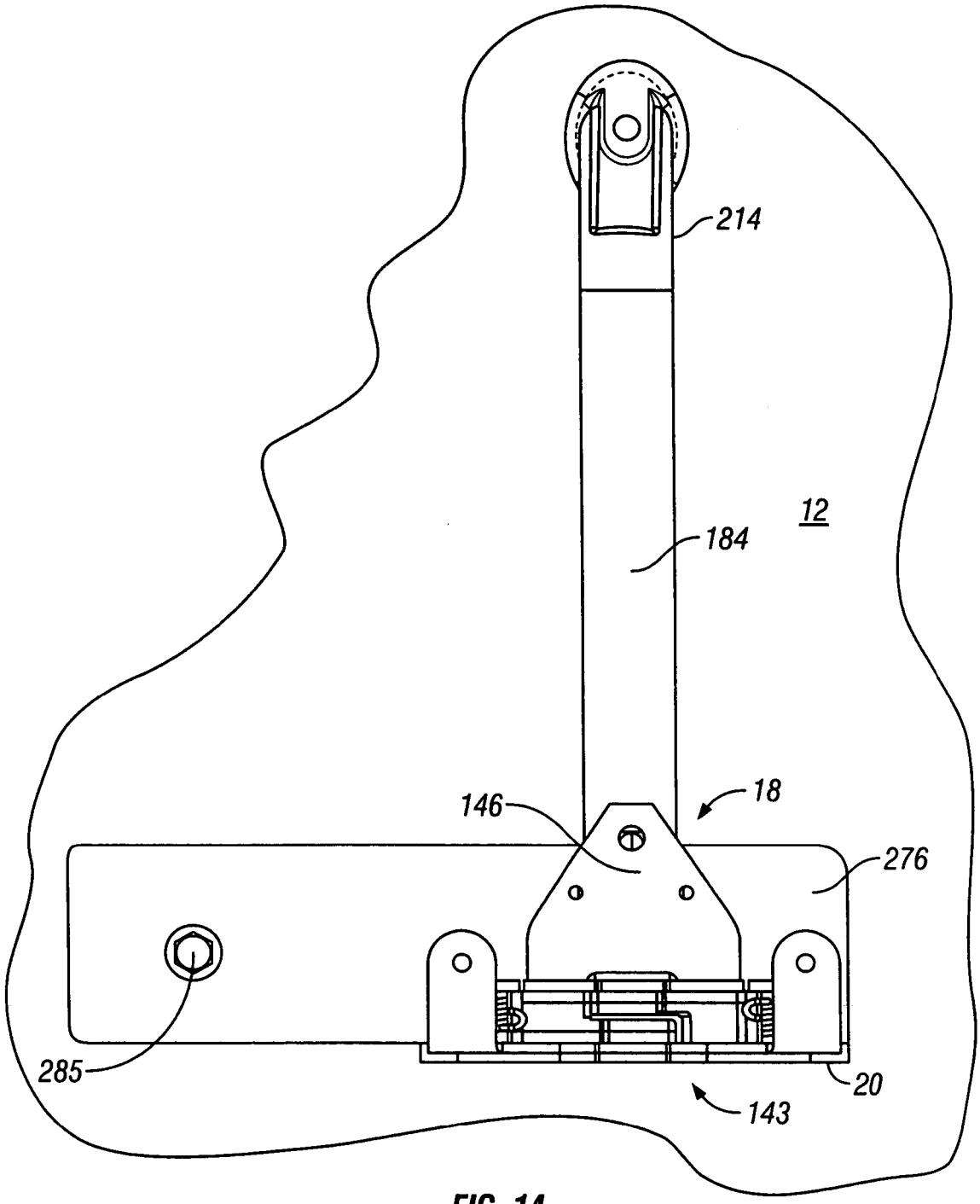
FIG. 14 is a rear elevation view of the combined subassembly in FIGS. 9-12 attached to a section of a movable closure element and with the protective shroud removed.

The first and second actuating assemblies 18, 19 and movable closure element 12 are interconnected through an angled mounting plate 276, as see in FIGS. 8, 14, and 15. The mounting plate 276 has a flat wall 278 which abuts to the movable closure element 12. Mounting bolts 280 are directed through the wall 278 and the movable closure element 12 and into threaded receptacles 282 in an enlarged portion 284 of the mounting base 236. A mounting bolt 285 extends through the mounting plate 276, the movable closure element 12, and into the mounting base 236.

A flat wall 286, orthogonal to the flat wall 278 on the mounting plate 276, is secured to the flat side 239 of the housing 20, either using separate bolts directed through prethreaded bores in the axles 30, 32, 74, 134, or by extending the axles 30, 32, 74, 134 therethrough and conforming the axles 30, 32, 74, 134 therearound. This mounting arrangement creates a space at 290 on the side of the movable closure element 12 at which the first actuating assembly 18 is mounted within which the locking tab 272 can move.

Figure 23:
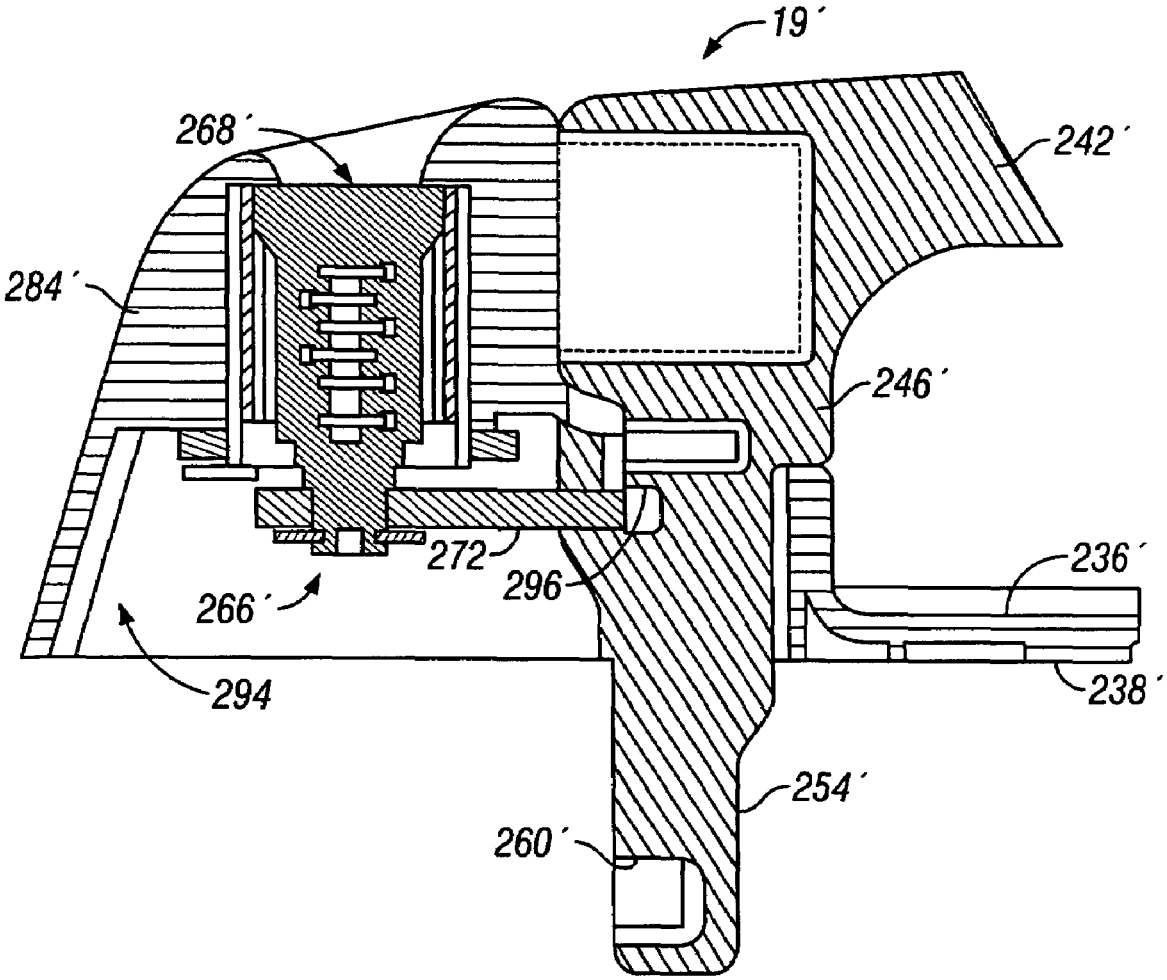
FIG. 23 is a fragmentary, cross-sectional view of a modified form of second actuating assembly with a modified form of locking assembly.

Alternatively, as shown in FIG. 23, the locking tab 272 can be mounted in a recess 294 on a modified form of a second actuating assembly 19', similar to the second actuating assembly 19, and having corresponding parts identified with a“”. The second actuating assembly 19' has a mounting base with a flat mounting surface 238' and an actuating handle 242' pivotably attached to the base 236'. The actuating handle 242' has a leg 246' with a projecting element/cantilevered connecting element 254' with an opening 260' to receive the post 258. The actuating handle has a slot 296 to receive the locking tab in the locked state therefor, as shown in FIG. 23. By rotating a cylinder 268', the tab 272 can be pivoted to an unlocked state, wherein the tab 272 resides outside of the slot 270 so as not to inhibit movement of the actuating handle 242'. This embodiment affords a compact lock assembly 266' within the recess 294 in an enlarged portion 284' of the base 236'. As seen in FIGS. 9-11 and 16, the configuration of the trip latch 158 is such that it is pivotable independently of the trip lever 144 around the pin axis 162 to cause the catch assembly 56 to be moved from the engaged position by applying a force in the direction of the arrow 300 on the surface 302 to the left of the pivot axis 162 in FIG. 16. This force can be imparted by a pushbutton actuating assembly 19' that can be used in place of the actuating assembly 19 on the door 12. The pushbutton actuating assembly 19' has an actuating element 302 that is translatable substantially in a line 304 between normal and release positions by a push button 305. In moving from the normal position to the release position, by movement in the line 304 in the direction of the arrow 306, the actuating element 302 imparts an actuating force directly to the surface 302.

The foregoing disclosure of specific embodiments is intended to be illustrative of the broad concepts comprehended by the invention.

The invention claimed is:

1. A latch assembly kit comprising:

a) a latching subassembly for mounting upon a movable closure element having first and second sides, the latching subassembly having i) a latched state wherein the latching subassembly releasably engages a strike element to maintain the movable closure element in a desired position relative to a support to which the movable closure element is attached, and ii) a release state;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state; and c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein with the first actuating assembly mounted to the first side of the movable closure element, a first part on the first actuating assembly that directly engages and interacts with the latching subassembly moves in a first manner as the first actuating assembly is changed from its normal state into its release state to thereby change the latching subassembly from its latched state into its release state, wherein with the second actuating assembly mounted to the first side of the movable closure element, a second part on the second actuating assembly moves in a second manner, that is different than the first manner, as the second actuating assembly is changed from its normal state into its release state to thereby change the latching subassembly from its latched state into its release state, wherein the kit further comprises a third actuating assembly mountable to the second side of the movable closure element with either of the first and second actuating assemblies mounted to the first side of the movable closure element and having normal and release states, the third actuating assembly causing the latching subassembly to change from its latched state into its release state as an incident of the third actuating assembly changing from its normal state into its release state, wherein with the second actuating assembly mounted to the first side of the movable closure element, a part on the second actuating assembly directly engages and interacts with a part of the third actuating assembly so as to thereby change the latching subassembly from its latched state into its release state as an incident of the second actuating assembly being changed from its normal state into its release state.

2. The latch assembly kit according to claim 1 wherein the first actuating assembly comprises an actuating handle that is mounted for pivoting movement between normal and release positions to thereby change the latching subassembly from its latched state into its release state.

3. The latch assembly kit according to claim 1 wherein the latching subassembly comprises a rotor that is pivotable between a latched position and a release position and the rotor is engageable with a strike element relative to which the movable closure element can be moved to thereby releasably maintain the movable closure element in a desired position.

4. The latch assembly kit according to claim 1 further in combination with a movable closure element on which the latching subassembly is mounted.

5. A latch assembly kit comprising:

a) a latching subassembly for mounting upon a movable closure element having first and second sides, the latching subassembly comprising a rotor that is movable between a latched position and a release position, the latching subassembly having i) a latched state wherein the rotor is in the latched position and releasably engages a strike element to maintain the movable closure element in a desired position relative to a support to which the movable closure element is attached, and ii) a release state wherein the rotor is in the release position;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state;

c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein the first actuating assembly comprises a pushbutton actuator having an element that is translatable from a normal position into a release position to directly engage and thereby change the latching subassembly from its latched state into its release state, wherein the second actuating assembly comprises an element that is pivotable from a normal position into a release position to thereby change the latching assembly from its latched state into its release state; and d) an operating assembly comprising a catch block assembly that is movable between i) an engaged position, wherein the catch block assembly maintains the rotor in the latched position; and ii) disengaged position wherein the rotor is permitted to move from its latched position into its release position.

6. The latch assembly kit according to claim 5 wherein the element on the second actuating assembly comprises a graspable actuating handle.

7. The latch assembly kit according to claim 6 wherein the kit further comprises a third actuating assembly mountable to the second side of the movable closure element and having normal and release states, the third actuating assembly causing the latching subassembly to change from its latched state into its release state as an incident of the third actuating assembly changing from its normal state into its release state.

8. A latch assembly kit comprising:

a) a latching subassembly for mounting upon a movable closure element having first and second sides, the latching subassembly having i) a latched state wherein the latching subassembly releasably engages a strike element to maintain the movable closure element in a desired position relative to a support to which the movable closure element is attached, and ii) a release state;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state; and c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein with the first actuating assembly mounted to the first side of the movable closure element, a first part on the first actuating assembly that directly engages and interacts with the latching subassembly moves in a first manner as the first actuating assembly is changed from its normal state into its release state to thereby change the latching subassembly from its latched state into its release state, wherein with the second actuating assembly mounted to the first side of the movable closure element, a second part on the second actuating assembly moves in a second manner, that is different than the first manner, as the second actuating assembly is changed from its normal state into its release state to thereby change the latching subassembly from its latched state into its release state, wherein the kit further comprises a third actuating assembly mountable to the second side of the movable closure element with either of the first and second actuating assemblies mounted to the first side of the movable closure element and having normal and release states, the third actuating assembly causing the latching subassembly to change from its latched state into its release state as an incident of the third actuating assembly changing from its normal state into its release state, wherein the third actuating assembly comprises a trip lever that is pivotable around an axis between normal and release positions to thereby change the latching assembly from its latched state into its release state.

9. A latch assembly kit comprising:

a) a latching subassembly for mounting upon a movable closure element having first and second sides, the latching subassembly having i) a latched state wherein the latching subassembly releasably engages a strike element to maintain the movable closure element in a desired position relative to a support to which the movable closure element is attached, and ii) a release state;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state; and c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein with the first actuating assembly mounted to the first side of the movable closure element, a first part on the first actuating assembly that directly engages and interacts with the latching subassembly moves in a first manner as the first actuating assembly is changed from its normal state into its release state to thereby change the latching subassembly from its latched state into its release state, wherein with the second actuating assembly mounted to the first side of the movable closure element, a second part on the second actuating assembly moves in a second manner, that is different than the first manner, as the second actuating assembly is changed from its normal state into its release state to thereby change the latching subassembly from its latched state into its release state, wherein the kit further comprises a third actuating assembly mountable to the second side of the movable closure element with either of the first and second actuating assemblies mounted to the first side of the movable closure element and having normal and release states, the third actuating assembly causing the latching subassembly to change from its latched state into its release state as an incident of the third actuating assembly changing from its normal state into its release state wherein the third actuating assembly comprises a trip lever that is pivotable around a first axis between normal and release positions to thereby change the latching subassembly from its latched state into its release state, and the first actuating assembly comprises an actuating handle that is mounted for pivoting movement around a second axis between normal and release positions to thereby change the latching assembly from its latched state into its release state.

10. The latch assembly kit according to claim 9 wherein the first and second axes are substantially parallel to each other.

11. The latch assembly kit according to claim 9 wherein the first and second axes are substantially orthogonal to each other.

12. The latch assembly kit according to claim 9 wherein the first and second axes reside in planes that do not intersect the movable closure element upon which the latching subassembly and first and third actuating assemblies are mounted.

13. A latch assembly kit comprising:

a) a latching subassembly for mounting upon a movable closure element having first and second sides, the latching subassembly having i) a latched state wherein the latching subassembly releasably engages a strike element to maintain the movable closure element in a desired position relative to a support to which the movable closure element is attached, and ii) a release state;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state; and c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein with the first actuating assembly mounted to the first side of the movable closure element, a first part on the first actuating assembly that directly engages and interacts with the latching subassembly moves in a first manner as the first actuating assembly is changed from its normal state into its release state to thereby change the latching subassembly from its latched state into its release state, wherein with the second actuating assembly mounted to the first side of the movable closure element, a second part on the second actuating assembly that interacts with the latching subassembly moves in a second manner, that is different than the first manner, as the second actuating assembly is changed from its normal state into its release state to thereby change the latching subassembly from its latched state into its release state, wherein the latching subassembly comprises a rotor that is pivotable between a latched position and a release position and the rotor is engageable with a strike element relative to which the movable closure element can be moved to thereby releasably maintain the movable closure element in a desired position, wherein the latch assembly kit further comprises a catch block assembly that is movable selectively between a) an engaged position wherein the rotor is maintained in its latched position and b) a disengaged position wherein the rotor is permitted to move from its latched position into its release position.

14. The latch assembly kit according to claim 13 wherein the latch assembly kit further comprises a trip latch that is movable from a first position into a second position to thereby change the catch block assembly from the engaged position into the disengaged position and a third actuating assembly mountable to the second side of the movable closure element and having normal and release states, the third actuating assembly causing the latching subassembly to change from its latched state into its release state as an incident of the third actuating assembly changing from its normal state into its release state, and the third actuating assembly comprises a trip lever that is movable between normal and release positions to thereby change the trip latch from the first position into the second position.

15. The latch assembly kit according to claim 14 wherein the trip latch is pivotable about a first axis between the first and second positions and the trip lever is pivotable about a second axis between its normal and release positions.

16. The latch assembly kit according to claim 15 wherein the first and second axes are substantially parallel.

17. The latch assembly kit according to claim 15 wherein the first and second axes are substantially coincident.

18. The latch assembly kit according to claim 15 wherein with the trip latch in the first position and the trip lever in its normal position, the trip latch can be moved from the first position into the second position without moving the trip lever from its normal position into its release position.

19. The latch assembly kit according to claim 18 wherein the first actuating assembly comprises a pushbutton actuator having an element that is translatable from a normal position into a release position to thereby pivot the trip latch from the first position into the second position.

20. The latch assembly kit according to claim 19 wherein the second actuating assembly comprises an actuating handle that is mounted for pivoting movement between normal and release positions to thereby change the catch block assembly from its engaged position into its disengaged position.

21. The latch assembly kit according to claim 20 wherein the actuating handle has a projecting element/cantilevered connecting element that follows pivoting movement of the actuating handle and directly engages the catch block assembly.

22. The latch assembly kit according to claim 21 wherein the catch block assembly comprises a cantilevered post that engages the projecting element/cantilevered connecting element.

23. The latch assembly kit according to claim 22 wherein the catch block assembly comprises a second cantilevered post that is engaged by the first actuating assembly so that the catch block assembly is moved from the engaged position into the disengaged position as the first actuating assembly is changed from its normal state into its release state.

24. In combination:

a) a movable closure element having first and second sides; and b) a latch assembly comprising:

a latching subassembly, the latching subassembly having i) a latched state wherein the latching subassembly has at least one rotor defining a receptacle into which a strike element can be directed and releasably maintained to thereby releasably maintain the movable closure element in a desired position relative to a support to which the movable closure element is attached with the at least one rotor in a latched position, and ii) a release state with the at least one rotor in a release position; and an operating assembly which is operable to change the latching subassembly from the latched state into the release state, the operating assembly comprising a first actuating assembly having normal and release states, the first actuating assembly mounted on the first side of the movable closure element and causing the latching subassembly to change from its latched state into its release state as an incident of the first actuating assembly changing from its normal state into its release state, the operating assembly comprising a catch block assembly that is movable in translation in a linear path selectively between a) an engaged position wherein the catch block assembly engages the at least one rotor to maintain the at least one rotor in the latched position whereby the latching subassembly is maintained in the latched state and b) a disengaged position wherein the rotor is allowed to move from the latched position into the release position and thereby the latching subassembly is permitted to be changed from its latched state into its release state, the operating assembly further comprising a trip latch that is on the first side of the movable closure element and engageable with the catch block assembly and movable around a first pivot axis between a first position and a second position to thereby cause the catch block assembly to be moved from the engaged position into the disengaged position, the operating assembly further comprising a trip lever that is movable around a second pivot axis between normal and release positions to thereby cause the trip latch to move from the first position into the second position, wherein the trip latch is movable from the first position into the second position without moving the trip lever from its normal position into its release position, the trip latch moved from its first position into its second position as an incident of the trip lever moving from its normal position into its release positions.

25. The combination according to claim 24 further comprising a second actuating assembly on the second side of the movable closure element and having normal and release states, the second actuating assembly acting against the trip latch and causing the trip latch to change from the first position into the second position without moving the trip lever from its normal position into its release position as the second actuating assembly is changed from its normal state into its release state.

26. The combination according to claim 25 wherein the second actuating assembly comprises a pushbutton actuator having an element that is translatable between normal and release positions to change the trip latch from the first position into the second position.

27. The combination according to claim 24 wherein the first and second axes are substantially parallel to each other.

28. The combination according to claim 24 wherein the first and second axes are substantially coincident.

29. The combination according to claim 24 further comprising a second actuating assembly on the second side of the movable closure element and having normal and release states, the second actuating assembly causing the catch block assembly to be moved from the engaged position into the disengaged position as an incident of the second actuating assembly changing from its normal state into its release state without requiring movement of the trip lever from its normal position into its release position.

30. The combination according to claim 29 wherein the catch block assembly has a first post which is engaged by the second actuating assembly and repositionable by the second actuating assembly as the second actuating assembly is changed from its normal state into its release state to cause the catch block assembly to be changed from the engaged state into the disengaged state.

31. The combination according to claim 29 wherein the catch block assembly has a post which is engaged by the trip latch and repositionable by the trip latch from the engaged position into the disengaged position as the catch block is changed from the first position into the second position.

32. The combination according to claim 29 wherein the second actuating assembly comprises an actuating handle that is pivotable between normal and release positions to thereby change the catch block assembly from the engaged position into the disengaged position.

33. The combination according to claim 24 further in combination with a movable closure element on which the latching subassembly is mounted.

34. In combination:

a) a movable closure element having first and second sides; and b) a latch assembly comprising;

a latching subassembly, the latching subassembly having i) a latched state wherein the latching subassembly has at least one rotor defining a receptacle into which a strike element can be directed and releasably maintained to thereby releasably maintain the movable closure element in a desired position relative to a support to which the movable closure element is attached with the at least one rotor in a latched position, and ii) a release state with the at least one rotor in a release position; and an operating assembly which is operable to change the latching subassembly from the latched state into the release state, the operating assembly comprising a first actuating assembly having normal and release states, the first actuating assembly mounted on the first side of the movable closure element and causing the latching subassembly to change from its latched state into its release state as an incident of the first actuating assembly changing from its normal state into its release state, the operating assembly comprising a catch block assembly that is movable selectively between a) an engaged position wherein the catch block assembly engages the at least one rotor to maintain the at least one rotor in the latched position whereby the latching subassembly is maintained in the latched state and b) a disengaged position wherein the rotor is allowed to move from the latched position into the release position and thereby the latching subassembly is permitted to be changed from its latched state into its release state, the operating assembly further comprising a trip latch that is on the first side of the movable closure element and engageable with the catch block assembly and movable around a first pivot axis between a first position and a second position to thereby cause the catch block assembly to be moved from the engaged position into the disengaged position, the operating assembly further comprising a trip lever that is movable around a second pivot axis between normal and release positions to thereby cause the trip latch to move from the first position into the second position, wherein the trip latch is movable from the first position into the second position without moving the trip lever from its normal position into its release position, the trip latch moved from its first position into its second position as an incident of the trip lever moving from its normal position into its release positions; and a second actuating assembly on the second side of the movable closure element and having normal and release states, the second actuating assembly causing the catch block assembly to be moved from the engaged position into the disengaged position as an incident of the second actuating assembly changing from its normal state into its release state without requiring movement of the trip lever from its normal position into its release position, wherein the catch block assembly has a first post which is engaged by the second actuating assembly and repositionable by the second actuating assembly as the second actuating assembly is changed from its normal state into its release state to cause the catch block assembly to be changed from the engaged state into the disengaged state, wherein the catch block assembly has a second post which is engaged by the trip latch and repositionable by the trip latch from the engaged position into the disengaged position as the catch block is changed from the first position into the second position.

35. The combination according to claim 34 wherein the first and second posts are spaced from each other and project in cantilevered fashion.

36. In combination:

a) a movable closure element having first and second sides; and b) a latch assembly comprising;

a latching subassembly, the latching subassembly having i) a latched state wherein the latching subassembly has at least one rotor defining a receptacle into which a strike element can be directed and releasably maintained to thereby releasably maintain the movable closure element in a desired position relative to a support to which the movable closure element is attached with the at least one rotor in a latched position, and ii) a release state with the at least one rotor in a release position; and an operating assembly which is operable to change the latching subassembly from the latched state into the release state, the operating assembly comprising a first actuating assembly having normal and release states, the first actuating assembly mounted on the first side of the movable closure element and causing the latching subassembly to change from its latched state into its release state as an incident of the first actuating assembly changing from its normal state into its release state, the operating assembly comprising a catch block assembly that is movable selectively between a) an engaged position wherein the catch block assembly engages the at least one rotor to maintain the at least one rotor in the latched position whereby the latching subassembly is maintained in the latched state and b) a disengaged position wherein the rotor is allowed to move from the latched position into the release position and thereby the latching subassembly is permitted to be changed from its latched state into its release state, the operating assembly further comprising a trip latch that is on the first side of the movable closure element and engageable with the catch block assembly and movable around a first pivot axis between a first position and a second position to thereby cause the catch block assembly to be moved from the engaged position into the disengaged position, the operating assembly further comprising a trip lever that is movable around a second pivot axis between normal and release positions to thereby cause the trip latch to move from the first position into the second position, wherein the trip latch is movable from the first position into the second position without moving the trip lever from its normal position into its release position.

the trip latch moved from its first position into its second position as an incident of the trip lever moving from its normal position into its release positions; and a second actuating assembly on the second side of the movable closure element and having normal and release states, the second actuating assembly causing the catch block assembly to be moved from the engaged position into the disengaged position as an incident of the second actuating assembly changing from its normal state into its release state without requiring movement of the trip lever from its normal position into its release position, wherein the second actuating assembly comprises an actuating handle that is pivotable between normal and release positions to thereby change the catch block assembly from the engaged position into the disengaged position, wherein the actuating handle has a projecting element/cantilevered connecting element that follows pivoting movement of the actuating handle and directly engages the catch block assembly.

37. The combination according to claim 36 wherein the catch block assembly comprises a cantilevered post that engages the projecting element/cantilevered connecting element.

38. A latch assembly kit comprising:

a) a latching subassembly for mounting upon a movable closure element having first and second sides, the latching subassembly having i) a latched state wherein the latching subassembly releasably engages a strike element to maintain the movable closure element in a desired position relative to a support to which the movable closure element is attached, and ii) a release state;

b) a first actuating assembly having a first configuration and normal and release states, the first actuating assembly mountable on the first side of the movable closure element and causing the latching subassembly to change from its latched state into its release state as an incident of the first actuating assembly changing from its normal state into its release state;

c) a second actuating assembly having a second configuration that is different than the first configuration and normal and release states, the second actuating assembly mountable to the first side of the movable closure element in place of the first actuating assembly and causing the latching subassembly to change from its latched state into its release state as an incident of the second actuating assembly changing from its normal state into its release state, wherein the first and second actuating assemblies can be selectively interchangeably mounted to the first side of the movable closure element to operate the latching subassembly, wherein with the first actuating assembly mounted to the first side of the movable closure element, a first part on the first actuating assembly interacts with the latching subassembly in a first manner as the first actuating assembly is changed from its normal state into its release state to thereby change the latching subassembly from its latched state into its release state, wherein with the second actuating assembly mounted to the first side of the movable closure element, a second part on the second actuating assembly interacts with the latching subassembly in a second manner that is different than the first manner as the second actuating assembly is changed from its normal state into its release state to thereby change the latching subassembly from its latched state into its release state; and wherein with the first actuating assembly mounted to the first side of the movable closure element the first part of the first actuating assembly engages the latching subassembly at a first location and with the second actuating assembly mounted to the first side of the movable closure element the second part of the second actuating assembly directly engages and interacts with a part of the third actuating assembly so as to thereby change the latching subassembly from the latched state into the release state as an incident of the second actuating assembly changing from its normal state into its release state, d) a third actuating assembly mountable to the second side of the movable closure element with either of the first and second actuating assemblies mounted to the first side of the movable closure element and having normal and release states, the third actuating assembly causing the latching assembly to change from its latched state into its release state as an incident of the third actuating assembly changing from the normal state into its release state.

39. The latch assembly kit according to claim 38 wherein with the first actuating assembly mounted to the first side of the movable closure element the first part of the first actuating assembly acts at a first location and with the second actuating assembly mounted to the first side of the movable closure element the second part of the second actuating assembly acts at a second location spaced from the first location to thereby impart a force that causes the latching assembly to change from its latched state into its release state.

* * * * *